US008033037B2

(12) United States Patent
Achterberg et al.

(10) Patent No.: US 8,033,037 B2
(45) Date of Patent: Oct. 11, 2011

(54) IRONING STATION

(75) Inventors: Lorraine L. Achterberg, Saint Joseph, MI (US); James William Kendall, Mount Prospect, IL (US); David M. Miller, Zeeland, MI (US); Ronald M. Nowell, Jr., Saint Joseph, MI (US); William J. Schill, Jr., Mattawan, MI (US); Richard A. Sunshine, Granger, IN (US); Ameresh Babu Viswanathan, Saint Joseph, MI (US); Vicki Lyn Wyatt, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 224 days.

(21) Appl. No.: 12/497,919

(22) Filed: Jul. 6, 2009

(65) Prior Publication Data

US 2009/0313863 A1 Dec. 24, 2009

Related U.S. Application Data

(63) Continuation-in-part of application No. 11/323,270, filed on Dec. 30, 2005, now Pat. No. 7,555,856.

(51) Int. Cl.
*D06F 81/00* (2006.01)
*D06F 81/06* (2006.01)

(52) U.S. Cl. ..... 38/104; 38/107; 38/139

(58) Field of Classification Search ..... 38/103–140
See application file for complete search history.

(56) References Cited

U.S. PATENT DOCUMENTS

| | | | |
|---|---|---|---|
| 88,281 | A | 3/1869 | De Montigny |
| 496,655 | A | 5/1893 | Hilton |
| 699,922 | A | 5/1902 | Hyson et al. |
| 870,805 | A | 11/1907 | Trager |
| 900,347 | A | 10/1908 | Berry |
| 916,849 | A | 3/1909 | Darrow |
| 970,174 | A | 9/1910 | Booton |
| 1,078,882 | A | 11/1913 | Scott |
| 1,255,399 | A | 2/1918 | Ferren |

(Continued)

FOREIGN PATENT DOCUMENTS

CA 2567949 6/2007

(Continued)

OTHER PUBLICATIONS

NPL: Better Lifestyle Products; Rolling Mobile Laundry Ironing Center; Jul. 28, 2005; http://www.betterlifestyleproducts.com/mobile-laundry-center.html.

*Primary Examiner* — Ismael Izaguirre
(74) *Attorney, Agent, or Firm* — Clifton G. Green; McGarry Bair P.C.

(57) ABSTRACT

An ironing station has a cabinet defining an interior space, an accessible storage area defined within the interior space of the cabinet, an ironing board stowably mounted in the cabinet for movement between a stowed position and a use position. The ironing board can be coupled to the cabinet via a non-vertical guide rail. A handle can be coupled to the ironing board to aid a user in moving the ironing board between the stowed and use positions. A multi-position docking station can be provided on the top wall of the cabinet for receiving an iron. A cover can be provided for selectively covering the docking station.

24 Claims, 29 Drawing Sheets

U.S. PATENT DOCUMENTS

| | | | | | |
|---|---|---|---|---|---|
| 1,278,072 | A | | 9/1918 | Ossry | |
| 1,485,991 | A | | 3/1924 | Mulley | |
| 1,590,390 | A | | 6/1926 | Miller | |
| 1,659,427 | A | | 2/1928 | Danielson | |
| 1,673,583 | A | * | 6/1928 | Nystrom | 108/78 |
| 1,994,044 | A | | 3/1935 | Michelet | |
| 2,287,646 | A | | 12/1938 | Steele | |
| 2,339,495 | A | | 1/1944 | McMann | |
| 2,475,106 | A | | 4/1944 | Mohr et al. | |
| 2,624,137 | A | | 1/1948 | Gysin | |
| 2,447,480 | A | | 8/1948 | Stubbs | |
| 2,499,078 | A | | 2/1950 | Shaw | |
| 2,499,455 | A | | 3/1950 | Brochu | |
| 2,526,030 | A | | 10/1950 | Kagan | |
| 2,548,437 | A | | 4/1951 | Mantagas | |
| 2,650,442 | A | | 9/1953 | Johnson | |
| 2,787,849 | A | | 4/1957 | Lacey | |
| 3,022,589 | A | | 2/1962 | Kleinman | |
| 3,170,417 | A | | 2/1965 | Avidiya | |
| 3,245,161 | A | | 4/1966 | Adiletta et al. | |
| 3,483,954 | A | * | 12/1969 | Michalski | 206/223 |
| 3,516,523 | A | * | 6/1970 | Pemberton, Jr. | 190/11 |
| 3,688,706 | A | | 9/1972 | Merryweather | |
| 3,745,676 | A | | 7/1973 | Dikoff | |
| 4,049,332 | A | | 9/1977 | Boudreaux | |
| 4,602,446 | A | | 7/1986 | Guion | |
| D286,958 | S | | 12/1986 | Gualtieri | |
| 4,637,321 | A | | 1/1987 | Hasler et al. | |
| 4,986,395 | A | * | 1/1991 | Lewis | 190/1 |
| 4,995,681 | A | | 2/1991 | Parnell | |
| D315,068 | S | | 3/1991 | Miller | |
| D336,706 | S | | 6/1993 | Lechman et al. | |
| 5,241,766 | A | | 9/1993 | Walz et al. | |
| 5,290,998 | A | | 3/1994 | Couch et al. | |
| 5,294,009 | A | | 3/1994 | Maurer et al. | |
| 5,315,773 | A | | 5/1994 | Iwami et al. | |
| 5,444,928 | A | * | 8/1995 | Sagel | 38/139 |
| 5,452,531 | A | * | 9/1995 | Graville et al. | 38/104 |
| 5,778,573 | A | | 7/1998 | Nottingham et al. | |
| 5,967,342 | A | | 10/1999 | Steffine | |
| 5,974,980 | A | | 11/1999 | Kent | |
| 6,000,158 | A | * | 12/1999 | Zoellner | 38/104 |
| 6,253,472 | B1 | | 7/2001 | Gast | |
| 6,484,645 | B2 | | 11/2002 | Allen | |
| 6,572,208 | B2 | | 6/2003 | Albaizar et al. | |
| 6,604,473 | B2 | | 8/2003 | Felsenthal | |
| 6,883,257 | B2 | | 4/2005 | Couch et al. | |
| 7,062,871 | B1 | | 6/2006 | Smidt | |
| 7,100,316 | B2 | | 9/2006 | Obileye | |
| 7,210,254 | B2 | * | 5/2007 | Docker | 38/104 |
| 2002/0017117 | A1 | | 2/2002 | Sunshine et al. | |
| 2004/0134237 | A1 | | 7/2004 | Sunshine et al. | |
| 2007/0151130 | A1 | | 7/2007 | Sunshine et al. | |

FOREIGN PATENT DOCUMENTS

| | | | |
|---|---|---|---|
| EP | 1146161 | | 10/2001 |
| EP | 1371307 | | 12/2003 |
| EP | 1444922 | | 8/2004 |
| EP | 1495697 | | 1/2005 |
| FR | 2760761 | | 9/1998 |
| GB | 326511 | | 3/1930 |
| GB | 384352 | | 12/1932 |
| GB | 582959 | | 12/1946 |
| GB | 618803 | | 2/1949 |
| GB | 627538 | | 8/1949 |
| GB | 855965 | | 12/1960 |
| GB | 1355656 | | 6/1974 |
| GB | 1399827 | | 7/1975 |
| GB | 2271360 | | 4/1994 |
| GB | 2297982 | | 8/1996 |
| JP | 05277298 | | 10/1993 |
| JP | 406071100 A | * | 3/1994 |
| JP | 06343794 | | 12/1994 |
| JP | 8191998 | | 7/1996 |
| JP | 2002126395 | | 5/2002 |
| KR | 200201898 | | 11/2000 |
| KR | 20020024449 | | 3/2002 |
| KR | 1020040009401 | | 1/2004 |
| WO | 8803579 | | 5/1988 |
| WO | 9317601 | | 9/1993 |
| WO | 03035961 | | 5/2003 |
| WO | 2004063452 | | 7/2004 |
| WO | 2004110214 | | 12/2004 |
| WO | 2005045121 | | 5/2005 |

* cited by examiner

IRONING STATION

CROSS-REFERENCE TO RELATED APPLICATIONS

This application is a Continuation-in-Part of U.S. patent application Ser. No. 11/323,270, filed Dec. 30, 2005, now U.S. Pat. No. 7,555,856, issued Jul. 7, 2009, which is incorporated herein by reference in its entirety.

BACKGROUND OF THE INVENTION

1. Field of the Invention

The present invention relates to an ironing station.

2. Description of the Related Art

Laundry appliances, such as washing machines and clothes dryers, for cleaning fabric items are commonly housed in one area of a home, such as a dedicated laundry room. Basic laundry care and cleaning of fabric items requires washing and drying fabric items. Additional laundry care can require other steps, including ironing to remove or reduce wrinkles in fabric items.

Ironing is often done away from the laundry room, since many laundry rooms have space restrictions that prohibit the user from setting up an ironing board and ironing fabric items within the laundry room. Most irons must be plugged into an electrical outlet for power, thus further limiting the area in which ironing can be accomplished. Some cordless irons are available to consumers, but these irons require a recharging stand that must be set up and plugged into an electrical outlet.

Laundry aids and equipment used during ironing are stored when not in use, and it is advantageous to the user to store these items near the location where they are used. Some users use separate storage means, such as shelving systems, cabinets, or cupboards, that are added to a laundry room to the often limited area not already utilized by the washing machine or clothes dryer. These separate storage means can lend a haphazard appearance the laundry room, especially when compared to a matched-set washing machine and clothes dryer.

Ironing requires additional equipment, including an iron and ironing board and can require one or more laundry aids. A laundry aid is a substance or agent used to clean or care for fabric items, such as, but not limited to, a laundry detergent, fabric softener, dryer sheets, bleach, spray-dewrinkler, starch, or other substance used for cleaning or caring for fabric items.

SUMMARY OF THE INVENTION

According to one aspect of the invention, an ironing station comprises a cabinet comprising spaced side walls connected by a top wall to at least partially define an interior space accessible through an open face of the cabinet, an ironing board having a first end and stowably mounted to the cabinet for selective movement between a stowed position, wherein at least a portion of the ironing board is received within the interior space, and a use position, and a handle coupled with the first end for aiding a user in moving the ironing board between the stowed position and the use position.

According to another aspect of the invention, an ironing station comprises a cabinet comprising spaced side walls connected by a top wall to at least partially define an interior space accessible through an open face of the cabinet, a base located within the interior space, an ironing board stowably mounted to the cabinet for selective movement between a stowed position, wherein at least a portion of the ironing board is received within the interior space, and a use position, and at least one guide rail orientated at an angle other than vertical and slidably coupling the ironing board to the base to effect movement of the ironing board between the stowed position and the use position.

According to yet another aspect of the invention, an ironing station comprises a cabinet comprising spaced side walls connected by a top wall to at least partially define an interior space accessible through an open face of the cabinet, an ironing board stowably mounted to the cabinet for selective movement between a stowed position, wherein at least a portion of the ironing board is received within the interior space, and a use position, and a multi-position docking station provided on the top wall of the cabinet for docking an iron in at least two orientations.

According to still another aspect of the invention, an ironing station comprises a cabinet comprising spaced side walls connected by a top wall to at least partially define an interior space accessible through an open face of the cabinet, an ironing board stowably mounted to the cabinet for selective movement between a stowed position, wherein at least a portion of the ironing board is received within the interior space, and a use position, a docking station provided on the top wall of the cabinet for docking an iron, and a cover for selectively covering the docking station.

DESCRIPTION OF EMBODIMENTS OF THE INVENTION

Figure 1:
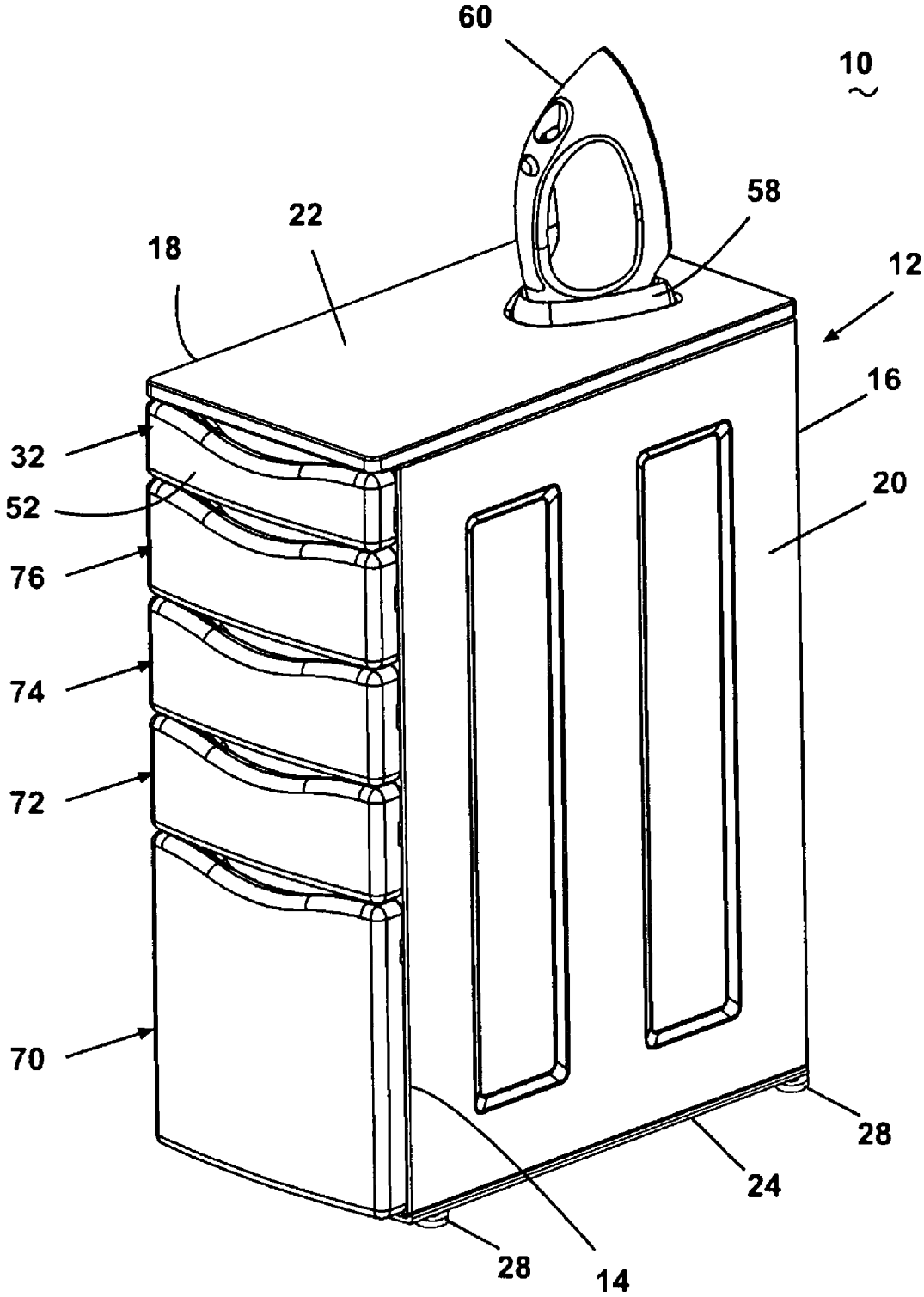
FIG. 1 is a perspective view of a portable ironing station according to a first embodiment of the invention, with an ironing board in a stowed position.

Referring to the drawings, FIG. 1 illustrates an ironing station 10 according to one embodiment of the invention. The ironing station 10 comprises a cabinet 12 having spaced front and rear walls 14, 16 joined by spaced left and right side walls 18, 20 and enclosed by spaced top and bottom walls 22, 24. The cabinet 12 defines an interior space of the ironing station 10, and can have an opening in one of the walls to provide access to the interior space, as will be described below. The ironing station 10 can have a roughly rectangular box shape with a height, width, and depth defining the spatial dimensions of the ironing station 10. By way of example, and without limitation, the dimensions of the ironing station 10 can be about 35"H×13.5"W×25.75"D. The ironing station 10 can further comprise supports 28 that are connected to the bottom wall 24. The supports 28 are illustrated as posts on which the ironing station 10 stands, however, the supports 28 can also comprise wheels so that the ironing station 10 is portable and can easily be moved, for example, to clean underneath or behind the ironing station 10 or to move the ironing station 10 to a different location.

Figure 2:
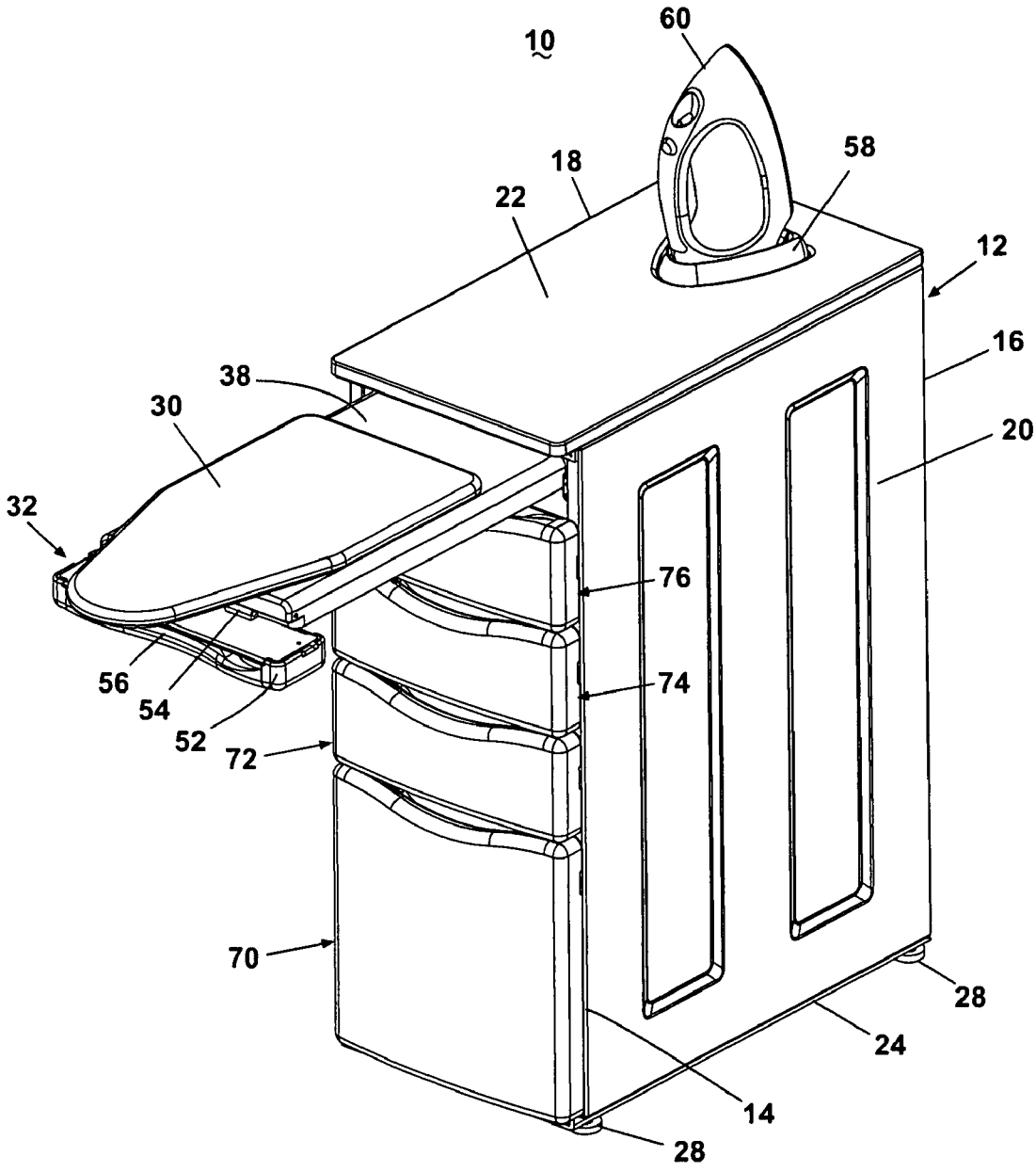
FIG. 2 is a perspective view of the ironing station from FIG. 1, with the ironing board in a use position.

Referring to FIG. 2, the ironing station 10 is provided with an ironing board 30 that is stowably mounted to the cabinet 12. The ironing board 30 can have a typical shape, with a tapered end and a blunt end. The ironing board 30 is selectively movable between a stowed position where the ironing board 30 is received within the interior space of the cabinet 12 (FIG. 1) and a use position where the ironing board 30 can be utilized for ironing purposes (FIG. 2). In the use position, the ironing board 30 can also be used as a shelf, such as for resting a laundry basket or other items. The ironing board 30 can be slidably mounted to the cabinet 12 for movement between the stowed and use positions. For example, the ironing board 30 can be carried by a support 32 that is slidably mounted to the cabinet 12, such that the support 32 slides through the front wall 14. The support 32 can be mounted in the cabinet 12 using any suitable mounting means such that the support 32 can slidably move relative to the cabinet 12. For example, a pair of runners (not shown) can be attached to the support 32 that interact with corresponding tracks attached to the inside surface of the left and right side walls 18, 20 of the cabinet 12.

Figure 3:
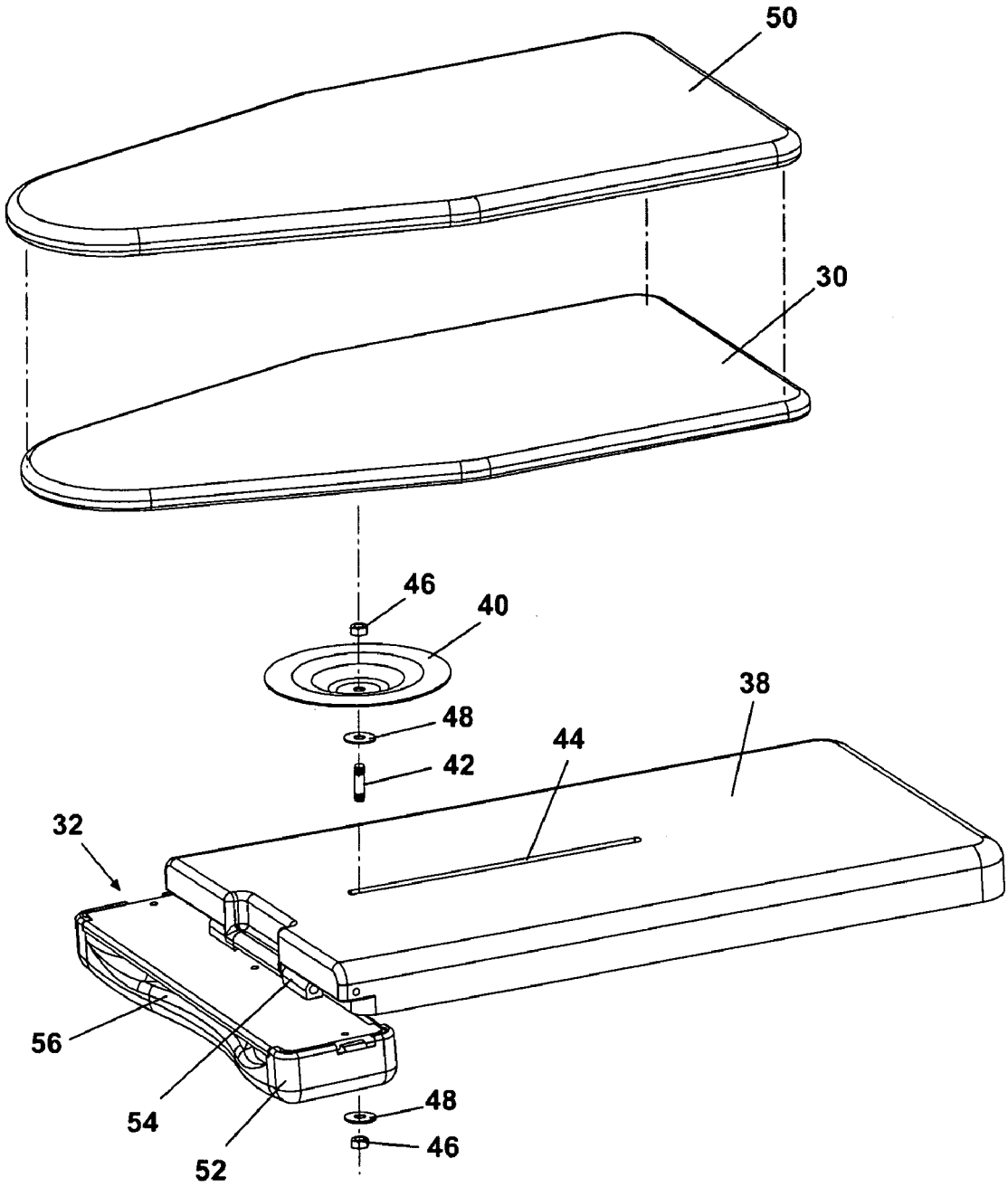
FIG. 3 is an exploded view of the ironing board and an ironing board support of the ironing station from FIG. 2.

Referring to FIG. 3, the support 32 comprises a platform 38 that movably supports the ironing board 30 for both linear and rotational movement. A rotating bracket 40 is attached to a bolt 42 that is slidable within a track 44 formed on the platform 38 such that as the bolt 42 slides linearly within the track 44, and the bracket 40 and the ironing board 30 slide likewise. The bolt 42 is threaded at both ends to receive a pair of nuts 46 and washers 48 that secures the bolt 42 and bracket 40 to the platform 38. The bracket 40 can be attached to the bottom surface of the ironing board 30 such that the ironing board 30 can be rotated relative to the support 32 through a number of positions encompassing a 360° range of movement, including a first exemplary position (shown in solid line in FIG. 4), where the pointed end of the ironing board 30 is toward the rear of the cabinet 12, a second exemplary position (shown in dash-dot-dash-dot line in FIG. 4), where the pointed end of the ironing board 30 is 90° from the first exemplary position, and a third exemplary position (shown in dotted line in FIG. 4), where the pointed end of the ironing board 30 is 180° from the first exemplary position. In the stowed position, the ironing board is typically positioned with the tapered end pointed toward the rear wall and the bolt 42 slid rearwardly in the track 44, such as shown by the first exemplary position. In the use position, the ironing board 30 is typically positioned with the bolt 42 slid forwardly in the track 44, however, the ironing board 30 can be rotated to any orientation so that the user can selectively use both the tapered end and the blunt end for different ironing needs, such as shown by the second and third exemplary positions. While the ironing board 30 is shown mounted to the platform 38 for both linear and rotational movement, it is within the scope of the invention for the ironing board 30 to be mounted to the platform 38 for only linear movement or for only rotation movement. A removable cover 50 can be placed over the ironing board 30, such as a washable elastic cover.

The support 32 further comprises a front panel 52 that is pivotally mounted to the forward end of the platform 38 and is pivotable between an up position, where the front panel 52 is generally perpendicular to the platform 38, as shown in FIG. 1, for hiding the ironing board 30 when the ironing board 30 is in the stowed position within the cabinet 12 and a down position, where the front panel 52 is generally parallel to the platform 38, as shown in FIGS. 2 and 3, for moving the ironing board 30 relative to the support. As best seen in FIG. 3, the front panel 52 can be pivotally mounted to the platform 38 by a hinge 54. The front panel 52 can further comprises a handle 56 integrally formed along the upper edge of the front panel 52 that allows the user to grip the handle 56 to slide the support 32 relative to the cabinet 12 and to pivot the front panel 52 relative to the platform 38.

An exemplary description of the operation of the ironing board 30 follows. It will be apparent to one of ordinary skill that the operation procedure can proceed in any logical order and is not limited to the sequence presented below. The following description is for illustrative purposes only and is not intended to limit the invention in any manner.

Figure 4:
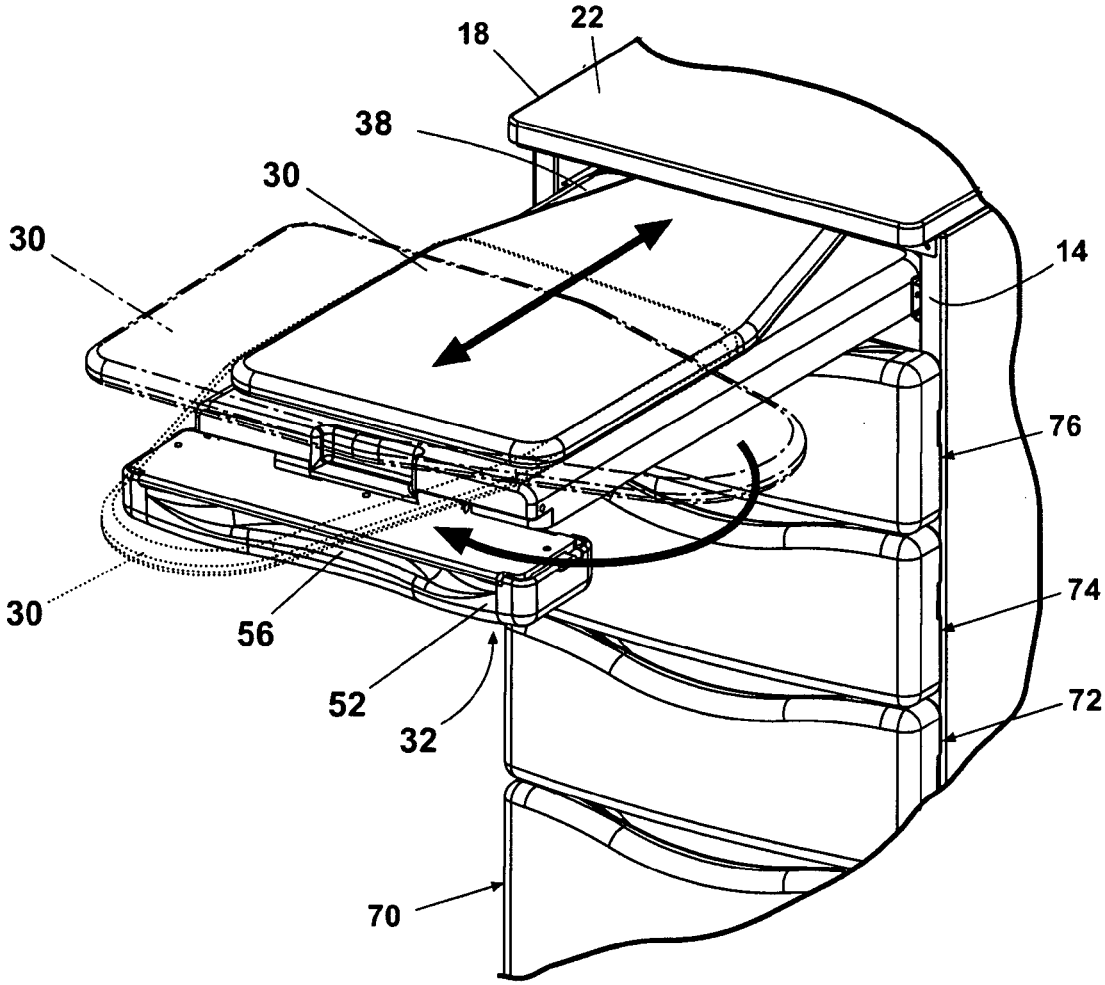
FIG. 4 is a perspective view of the ironing station from FIG. 1, illustrating the operation of the ironing board.

Referring to FIG. 4, to move the ironing board 30 from the stowed position to the use position, the support 32 is extended outward from the cabinet 12, and the front panel 52 is pivoted forwardly to the down position. The ironing board 30 is slid forward along the track 44 to allow the ironing board 30 to extend forwardly of the support 32. The ironing board 30 is then rotated to any desired angle with respect to the support 32. Two exemplary positions, 90° and 180° from the original orientation are illustrated, although the use position can comprise any orientation of the ironing board 30 in which the user can utilize the ironing board for ironing purposes.

Figure 5:
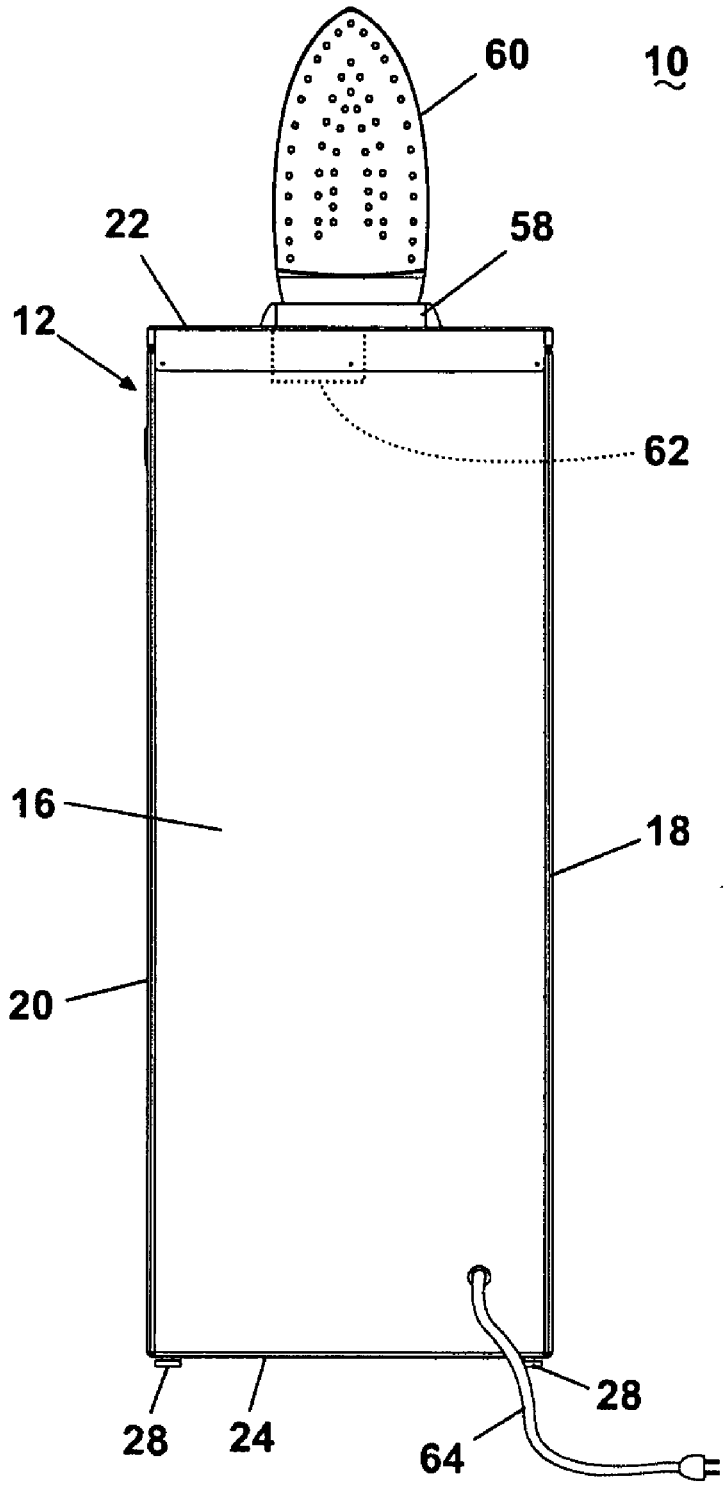
FIG. 5 is a rear review of the ironing station from FIG. 1.

Referring to FIG. 5, a docking station 58 for a receiving an iron 60 is provided on the top wall 22 of the cabinet 12. The docking station 58 comprises a power supply 62 to provide power to an iron 60. The power supply 62 can be mounted to the cabinet 12 or can be separate from the cabinet 12. The docking station 58 can have a power cord 64 that extends exteriorly of the cabinet 12, for example, through the rear wall 16, and supplies the power from a household power source to the power supply 62. The docking station 58 can be integrally formed in the top wall 22 of the cabinet 12 and can be positioned near the rear of the cabinet 12 for safety reasons so that, for example, a user does not inadvertently touch the iron 60 when hot and the iron 60 is kept out of reach for small children. The docking station 58 can support the iron 60 in an upstanding position as shown in FIG. 5, by being formed to complement the base of the iron 60. The iron 60 can be a cordless iron that is recharged by the power supply 62 when received by the docking station 58.

Figure 6:
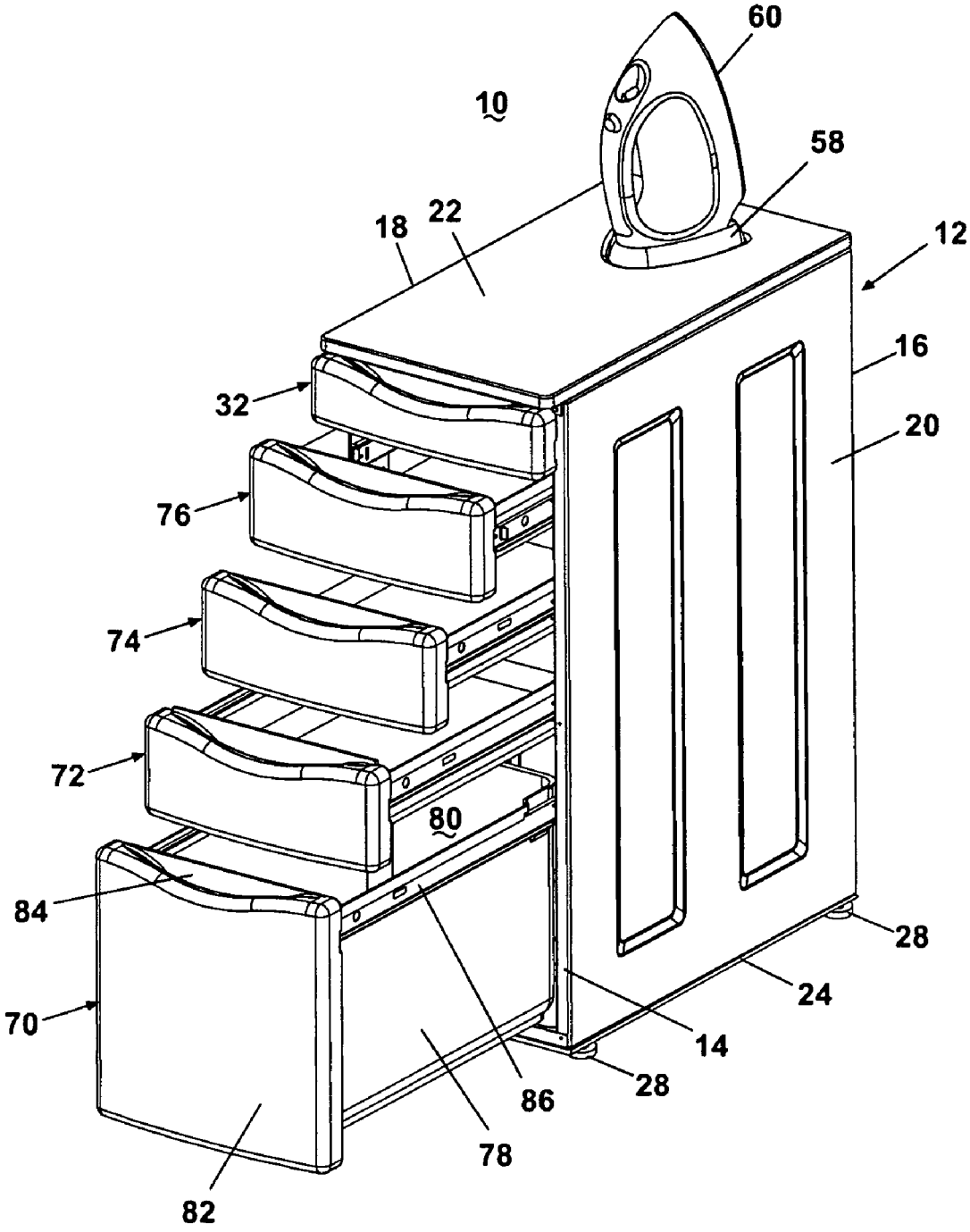
FIG. 6 is a perspective view of the ironing station from FIG. 1, with drawers in an open position.

The ironing station 10 further comprises a storage area defined within the interior space of the cabinet 12 that is accessed through an open face of the cabinet 12, for example, an open face formed in the front wall 14. Referring to FIG. 6, the storage area comprises four drawers 70, 72, 74, 76, that slidably open from the front wall 14 of the cabinet 12. The drawers 70, 72, 74, 76 are positioned in the cabinet 12 below the ironing board support 32.

The drawers 70, 72, 74, 76 will now be described with reference to the lowermost drawer 70, however, the description is applicable to the other drawers 72, 74, 76. The drawer 70 comprises a drawer body 78 defining a storage space 80 with an open top allowing the user to access the storage space 80 when the drawer 70 is extended from the cabinet 12. A front panel 82 is further joined to the front of the drawer body 78 using any suitable fastening means. The front panel 82 has a handle 84 integrally formed along the top edge of the front panel 82 to enable the user to pull the drawer 70 out from the cabinet 12 to access the storage space 80. The drawer 70 can be mounted to slidably open from the front wall 14 of the cabinet 12 using any suitable mounting means. For example, a pair of runners 86 can be attached to the outer surfaces of the drawer body 78 that interact with a corresponding pair of tracks (not shown) attached to the inside surface of the left and right side walls 18, 20 of the cabinet 12.

The width and depth of the drawers 70, 72, 74, 76 are such that the drawers 70, 72, 74, 76 can fit within the cabinet 12. The height of the drawers 70, 72, 74, 76 can vary, thus providing different amount of storage by varying the size of the storage space 80 in each drawer 70, 72, 74, 76 and allowing selective drawers to be easily accessed when the ironing board 30 is in the use position. The lowermost drawer 70 is preferably of a height where, for example, a laundry aid such as a bottle of detergent can stand upright in the drawer 70 without having to lie on a side, and the storage space 80 of the drawer 70 can be easily accessed when then ironing board 30 is in the use position. The preferred height for the lower drawer 70 is about 14.25". The upper three drawers 72, 74, 76 can be of lesser heights than the lower drawer 70. The preferred height for the upper three drawers 72, 74, 76 is about 5.25". While the drawers 72, 74 are easily accessible when the ironing board 30 is in the use position, the topmost drawer 76 is not.

The drawers 70, 72, 74, 76 can be used to provide needed storage for laundry aids and additional equipment. A laundry aid is a substance or agent used to clean or care for fabric items, such as, but not limited to, a laundry detergent, fabric softener, dryer sheets, bleach, spray-dewrinkler, or other substance used for cleaning fabric items. Additional equipment required for laundry care can include items such as hangers and hanging rods for hanging fabric items, and mesh-screens for flat-drying. The drawers 70, 72, 74, 76 can also be used to store the iron 60 when the iron 60 is not in use or received by the docking station 58.

Figure 7:
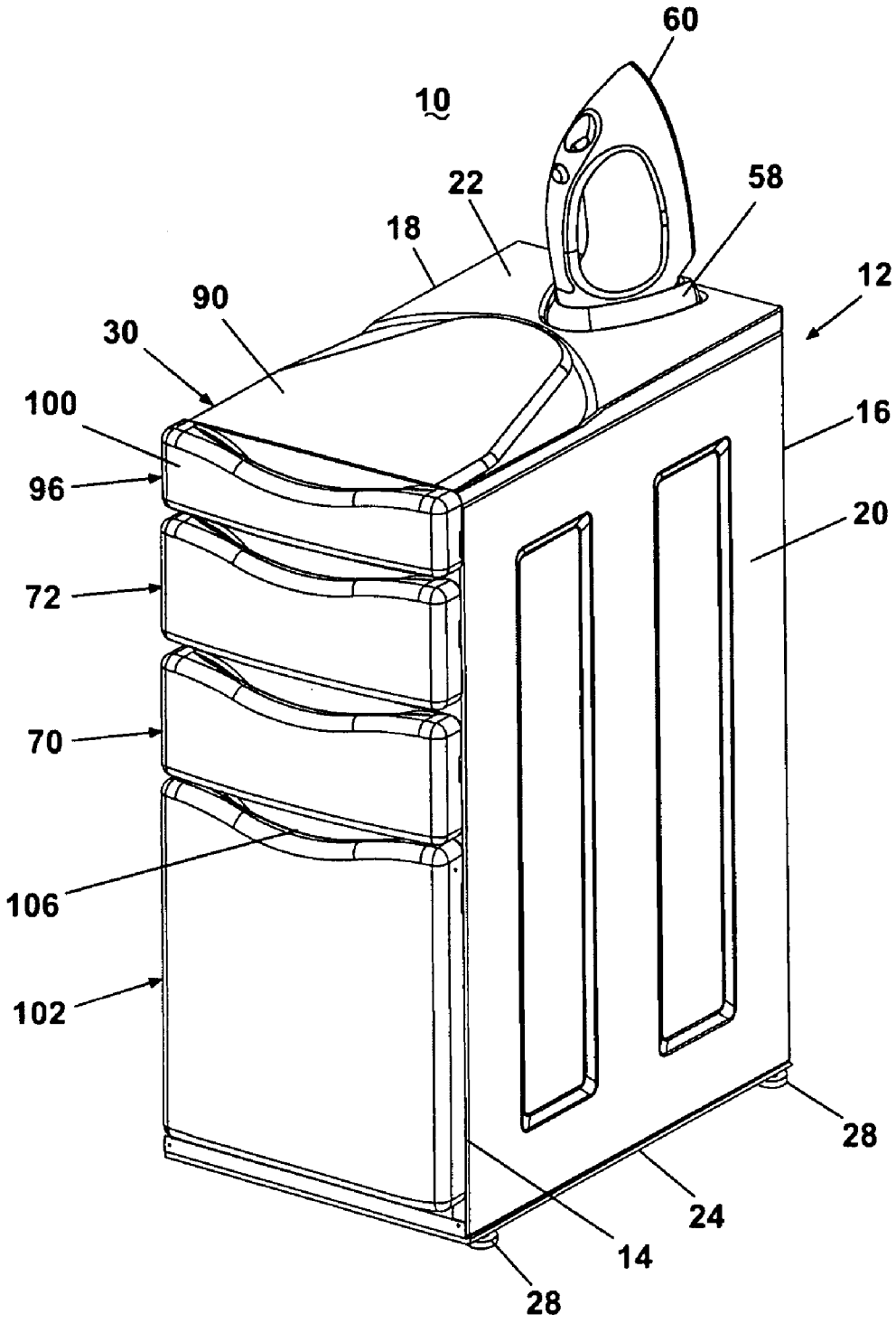
FIG. 7 is a perspective view of a portable ironing station according to a second embodiment of the invention, with an ironing board in a stowed position.
Figure 8:
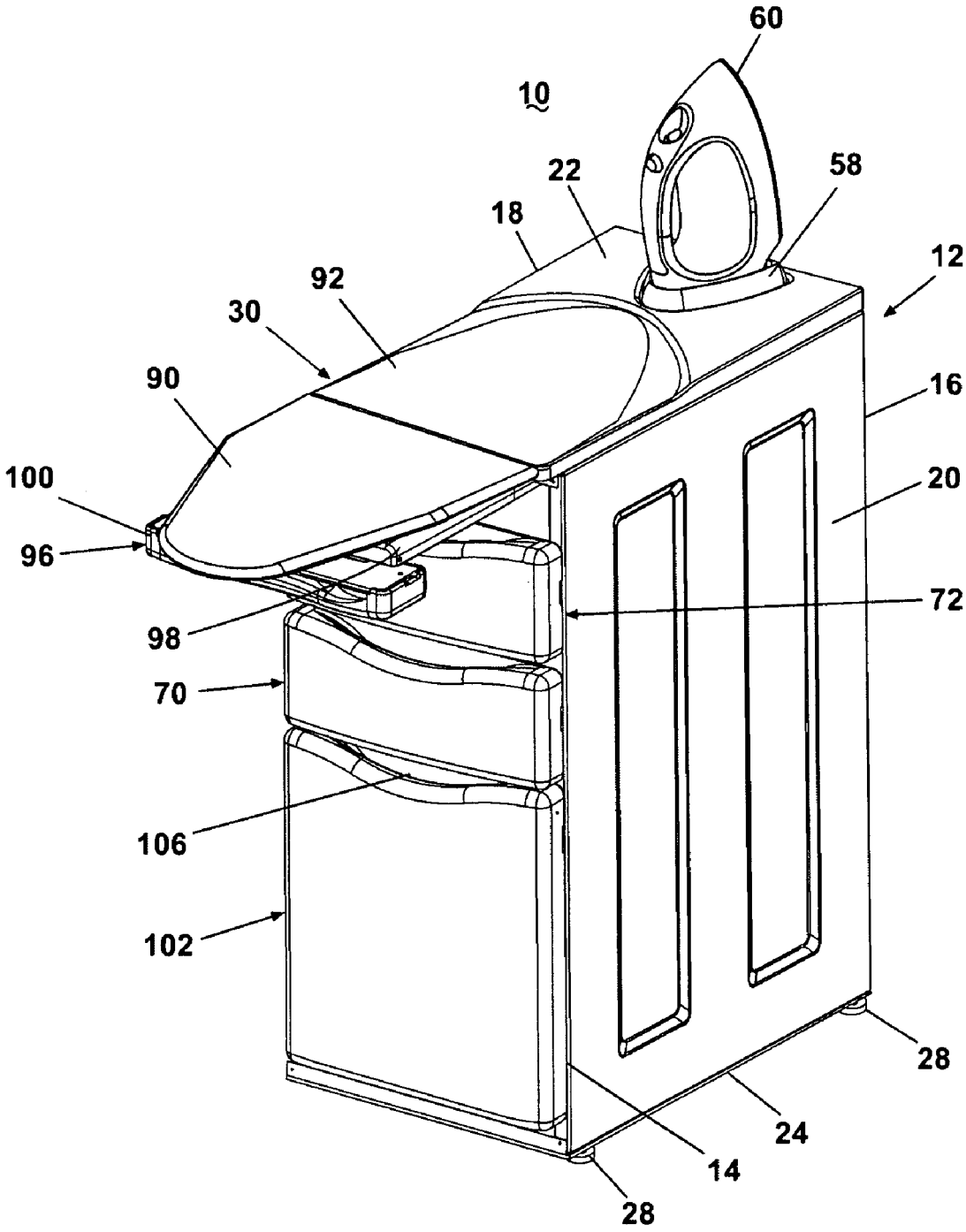
FIG. 8 is a perspective view of the ironing station from FIG. 7, with the ironing board in a use position.
Figure 9:
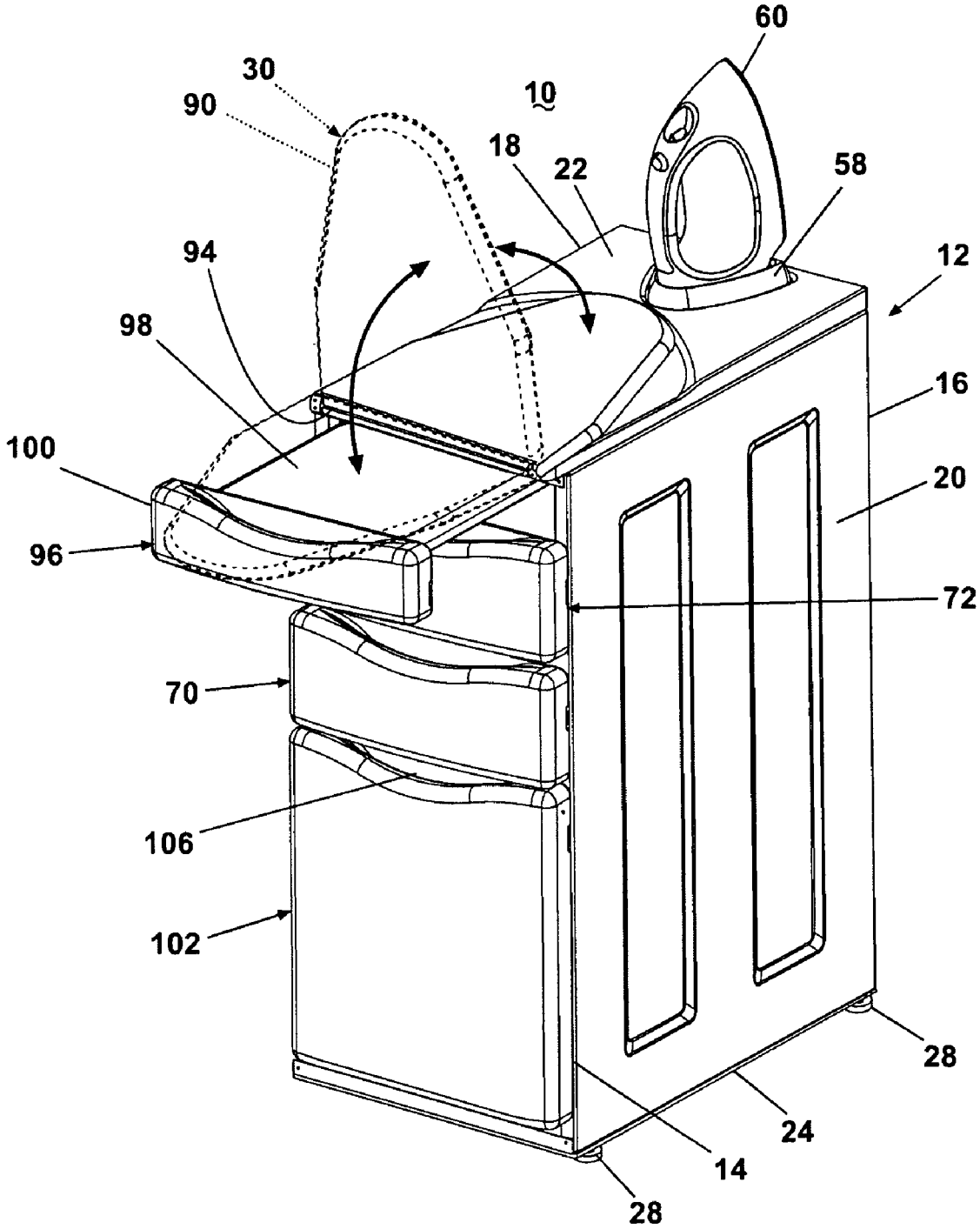
FIG. 9 is a perspective view of the ironing station from FIG. 7, illustrating the operation of the ironing board.

According to a second embodiment of the invention shown in FIG. 7, where elements similar to those of the previous embodiment are identified by the same reference numerals, the ironing station 10 can comprise an ironing board 30 that is pivotally mounted to the cabinet 12 for movement between the stowed and use positions. The ironing board 30 can be mounted to the cabinet 12A such that a portion of the ironing board 30 forms a generally continuous surface with the top wall 22 of the cabinet 12 when the ironing board 30 is in the stowed position. The ironing board 30 can comprise a leaf 90 that is pivotable from the stowed position, where the leaf 90 overlies a portion 92 of the top wall 22, to the use position (FIG. 8), where the leaf 90 extends from the cabinet 12 and the ironing board 30 can be utilized for ironing purposes. The portion 92 can form a rear portion of the ironing board 30 such the leaf 90 and rear portion 92 are substantially even when in the ironing board 30 is in the use position to form a continuous surface for ironing. The leaf 90 and rear portion 92 can be joined by a hinge 94 (FIG. 9). The shape of the rear portion 92 of the top wall complements the shape of the leaf 90, and the rear portion 92 is recessed in the top wall 22 a distance substantially equal to the thickness of the leaf 90 such that, when the ironing board 30 is in the stowed position, the leaf 90 is flush with the top wall 22 to form a generally continuous surface.

The ironing station 10 can further comprise a support 96 mounted to the cabinet 12 for supporting the leaf 90 when the ironing board 30 is in the use position. The support 96 can be mounted to slidably open from the front wall 14 of the cabinet 12 using any suitable mounting means. The support 96 can be positioned in the cabinet 12 beneath the ironing board 30 and can comprise a platform 98 on which the leaf 90 rests in the use position. A front panel 100 can be pivotally mounted to the forward end of the platform 98 and is pivotable between an up position, where the front panel 100 is generally perpendicular to the platform 98, as shown in FIGS. 7 and 9, for hiding the hinge 94 when the ironing board 30 is in the stowed position and a down position, where the front panel 100 is generally parallel to the platform 98, as shown in FIG. 8, for supporting the ironing board 30 on the platform 98. The support 96 can span the width of the cabinet 12 as illustrated, or can be of a lesser width.

An exemplary description of the operation of the ironing board 30 follows. It will be apparent to one of ordinary skill that the operation procedure can proceed in any logical order and is not limited to the sequence presented below. The following description is for illustrative purposes only and is not intended to limit the invention in any manner.

Referring to FIG. 8, to move the ironing board 30 from the stowed position to the use position, the support 96 is extended outward from the cabinet 12 and the front panel 96 is pivoted forwardly to the down position (FIG. 8). As shown by arrows and illustrated in phantom, the leaf 90 is pivoted about the hinge 94 to a generally horizontal position where the ironing board 30 extends forwardly of the support 96. Thus the rear portion 92 of the ironing board 30 is uncovered and is available to the user as an ironing surface, in addition to the leaf 90.

Figure 10:
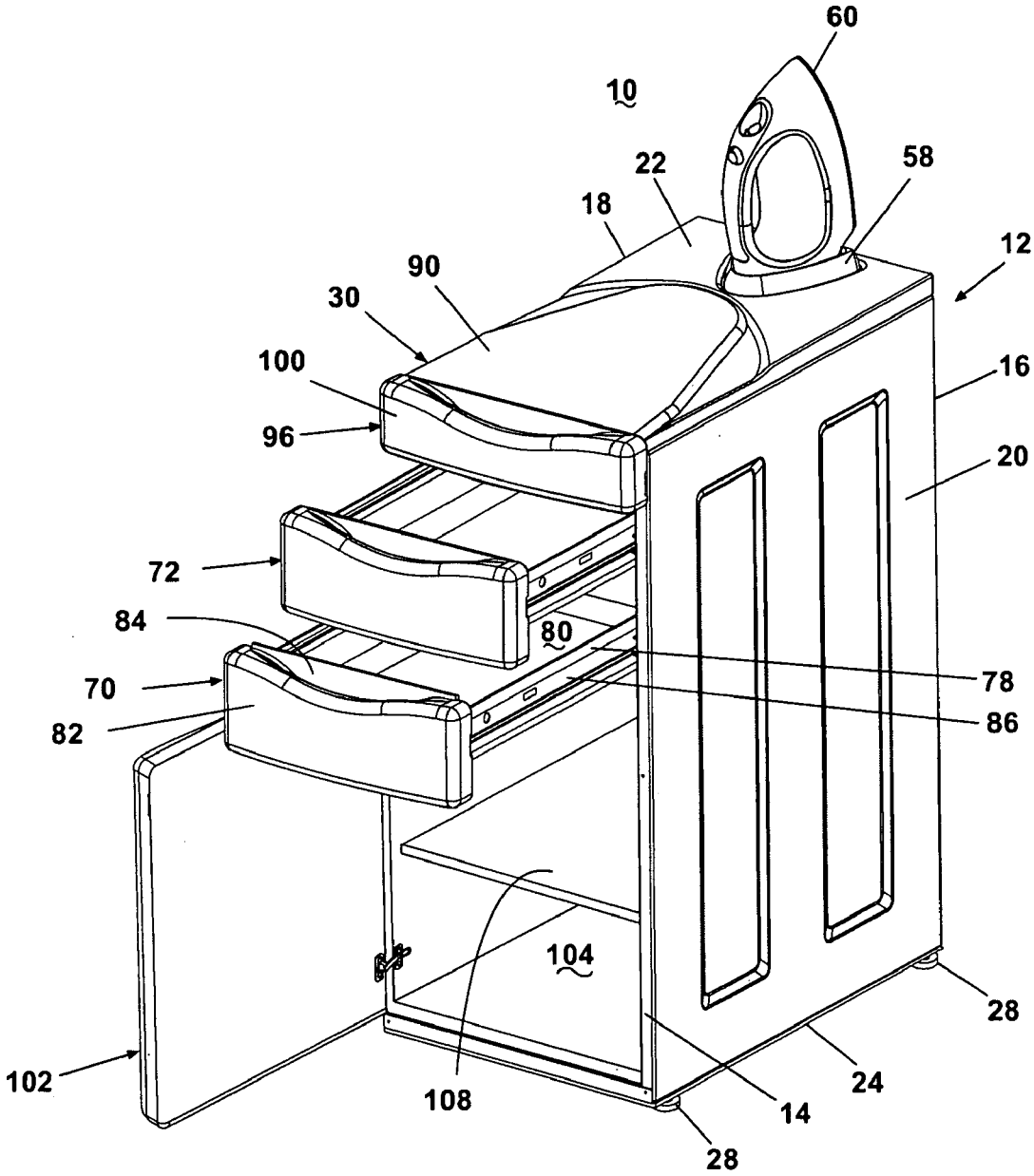
FIG. 10 is a perspective view of the ironing station from FIG. 7, with a door and drawers in an open position.

Referring to FIG. 10, the ironing station 10 further comprises a storage area defined within the interior space of the cabinet 12 that is accessed through an open face of the cabinet 12, for example, an open face formed in the front wall 14. The storage area comprises a door 102 that selectively closes a portion of the open face and two drawers 70, 72 that slidably open from the front wall 14 of the cabinet 12. The door 102 opens from the front wall 14 of the cabinet 12 to reveal a storage space 104. A handle 106 is formed on the door 102 to enable the user to grip the handle 106 and pull open the door 102. As illustrated, the handle 106 is integrally formed along the top edge of the door 102, but can also be formed along a side edge of the door 102 or as a separate piece attached to the front of the door 102. A shelf 108 is positioned in the storage space 104 and can be adjustable to adjust the vertical position of the shelf 108 or to completely remove the shelf 108.

The height of the door 102 and the drawers 70, 72 can vary, thus providing different amount of storage by varying the size of the respective storage spaces 104, 80. The door 102 is preferably of a height where, for example, a laundry aid such as a bottle of detergent can stand upright in the storage space 104 without having to lie on a side. The preferred height for the door 102 is about 14.25". The drawers 70, 72 can be of a lesser height than the door 102. The preferred heights for the drawers 70, 72 are about 5.25.

Figure 11:
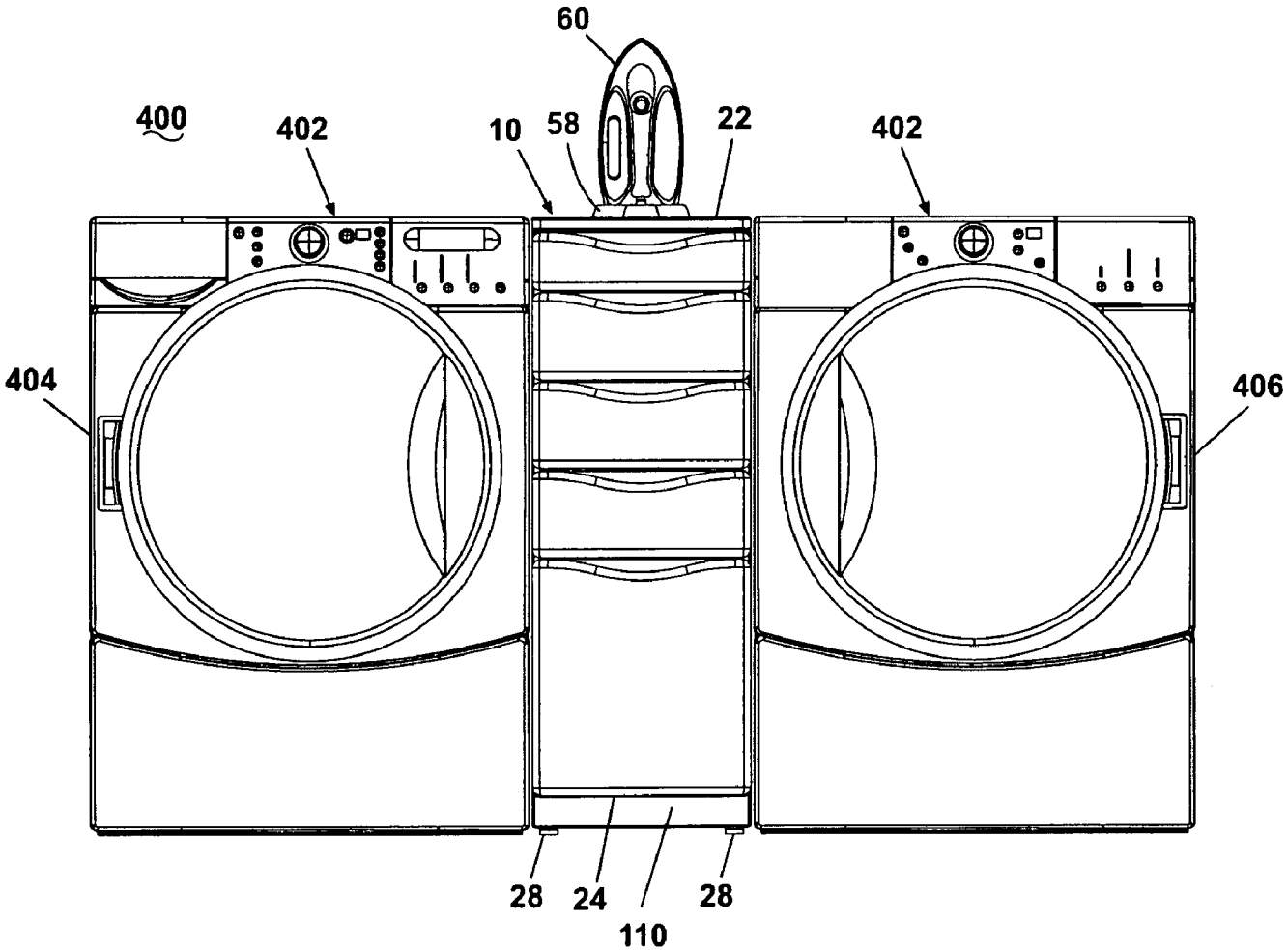
FIG. 11 is a front view of a laundry system comprising the ironing station according to the invention.

Referring to FIG. 11, an illustrative example of a laundry system 400 is given, where the ironing station 10 is positioned between two laundry appliances 402. The laundry appliances comprise a front-loading washing machine 404 and clothes dryer 406. Additional configurations of laundry systems 400 comprising the ironing station 10 are disclosed in the above-referenced patents.

As shown in FIG. 11, the ironing station 10 can optionally comprise a pedestal 110 that is mounted to the bottom wall 24 of the cabinet 12. The width and depth of the pedestal 110 are approximately equal to the width and depth of the ironing station 10. The height of the pedestal 110 can vary. An exemplary height for the pedestal 110 is about 2.36". The pedestal 110 functions as an adapter so that the user can custom tailor the ironing station 10. For example, the user can add the pedestal 110 to the ironing station 10 to raise the height of the ironing board 30 to a desired height for ironing. In another example, the user can add the pedestal 110 to the ironing station 10 to raise the height of the top wall 22 to a desired height that matches the height of another laundry appliance 200. This is especially useful when the ironing station 10 is positioned directly adjacent a laundry appliance 200, as shown in FIG. 11. The pedestal 110 can be added to any of the embodiments of the ironing station 10 discussed herein.

Figure 12:
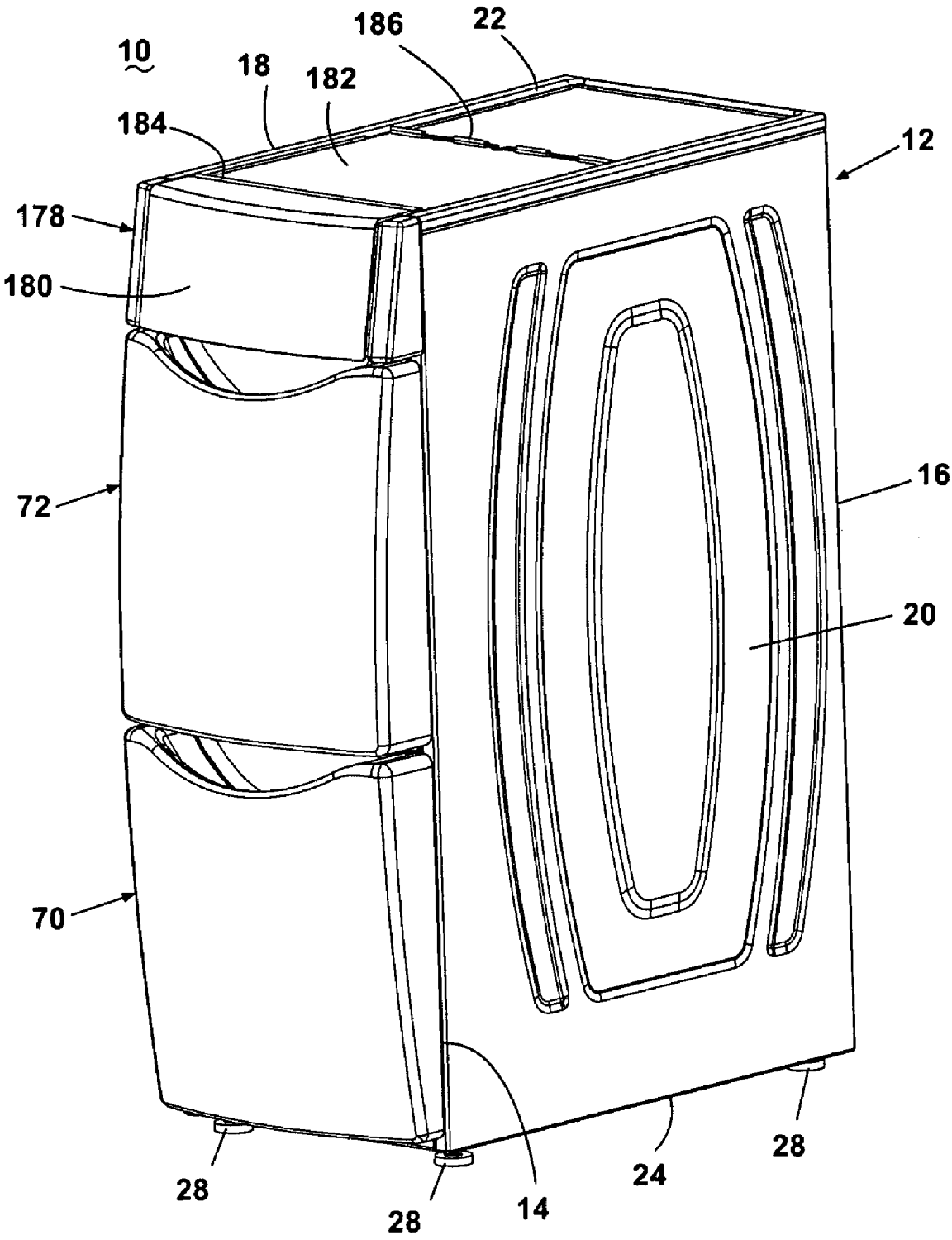
FIG. 12 is a perspective view of a portable ironing station according to a third embodiment of the invention, with the ironing board in a stowed position, and a cover in a closed position.
Figure 13:
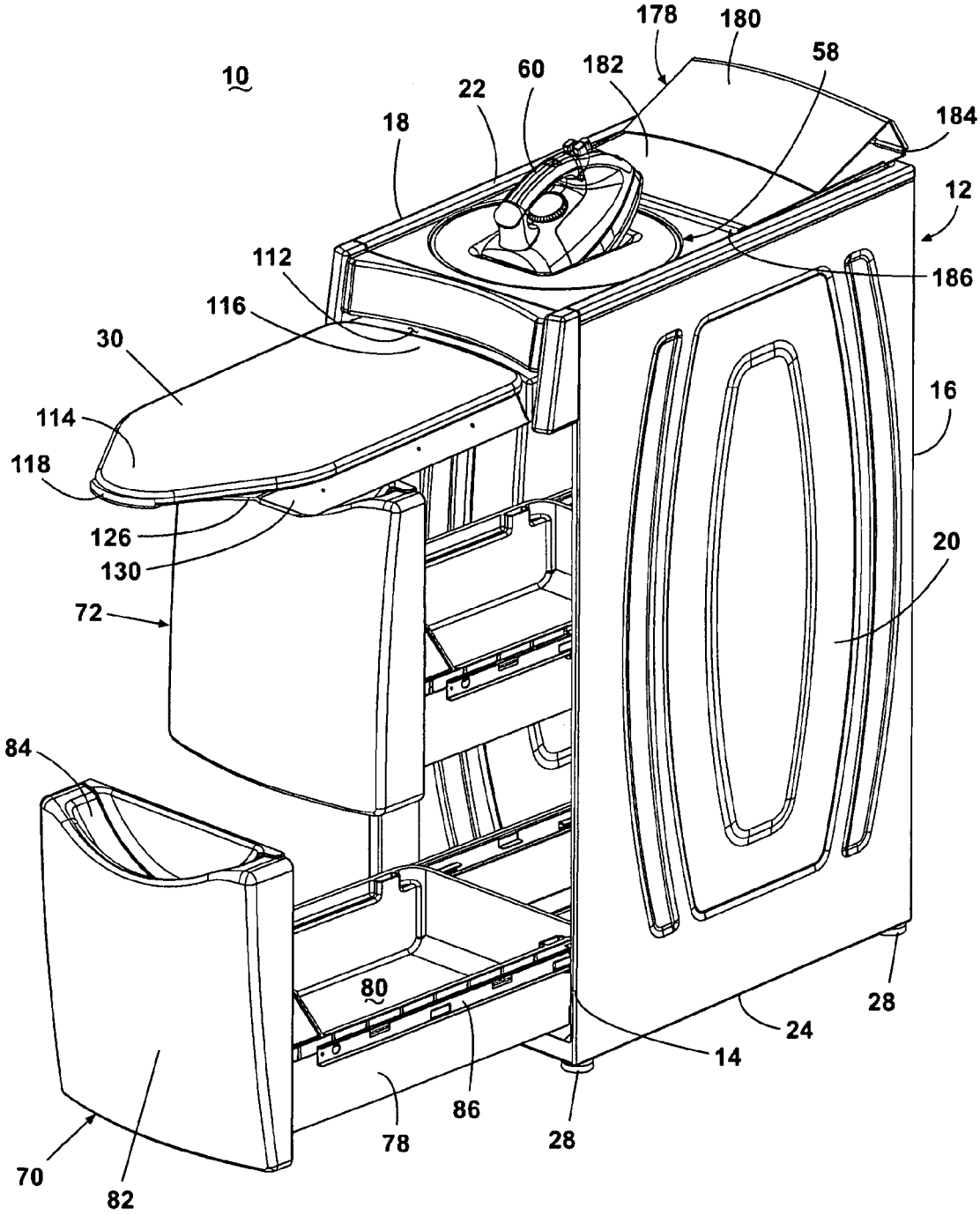
FIG. 13 is a perspective view of the ironing station from FIG. 12, with the ironing board in a use position and the cover in an open position.

According to a third embodiment of the invention shown in FIGS. 12 and 13, where elements similar to those of the previous embodiments are identified by the same reference numerals, the ironing station 10 is provided with an ironing board 30 stowably mounted to the cabinet 12 within the interior space of the cabinet 12. The ironing board 30 is selectively moveable between a stowed position where the ironing board 30 is received within a pocket 112 formed in the interior space of the cabinet 12 (FIG. 12) and a use position where the ironing board 30 can be utilized for ironing purposes (FIG. 13). The pocket 112 can accessed through an opening formed in the front wall 14.

The ironing station 10 further comprises a storage area defined within the interior space of the cabinet 12 that is accessed through an open face of the cabinet 12, for example an open face formed in the front wall 14. The storage area comprises two drawers 70, 72 that slidably open from the front wall 14 of the cabinet 12. The height of the drawers 70, 72 can vary, thus providing differing amounts of storage by varying the side of the respective storage spaces 80.

Figure 14:
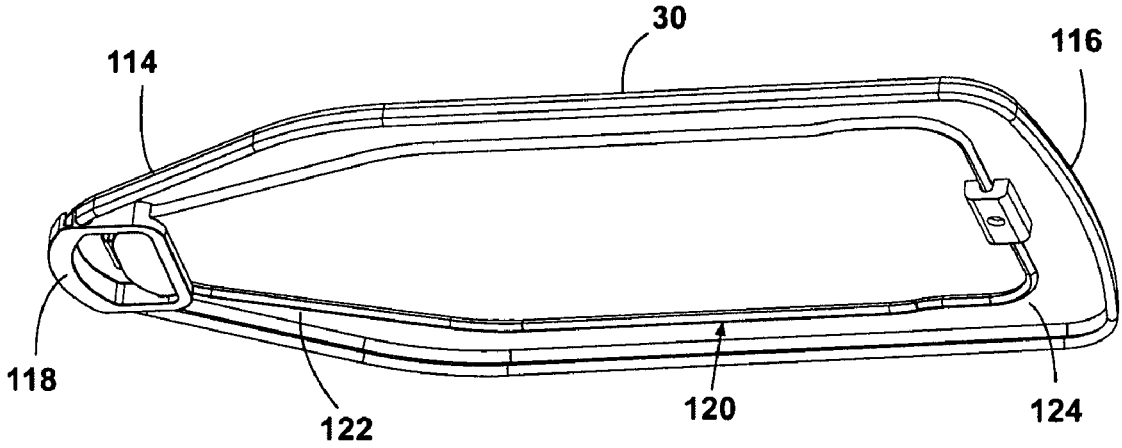
FIG. 14 is a bottom perspective view of the ironing board assembly from FIG. 12.

Referring to FIG. 14, the ironing board 30 can have a typical shape, with a tapered end 114 and a blunt end 116. A handle 118 is provided on the ironing board 30 for a user to grip to move the ironing board 30 in and out of the pocket 112. A reinforcement rod 120 is affixed to the underside of the ironing board 30 and has a closed loop shape that generally follows the shape of the ironing board 30, including a tapered end portion 122 and a blunt end portion 124.

Figure 15:
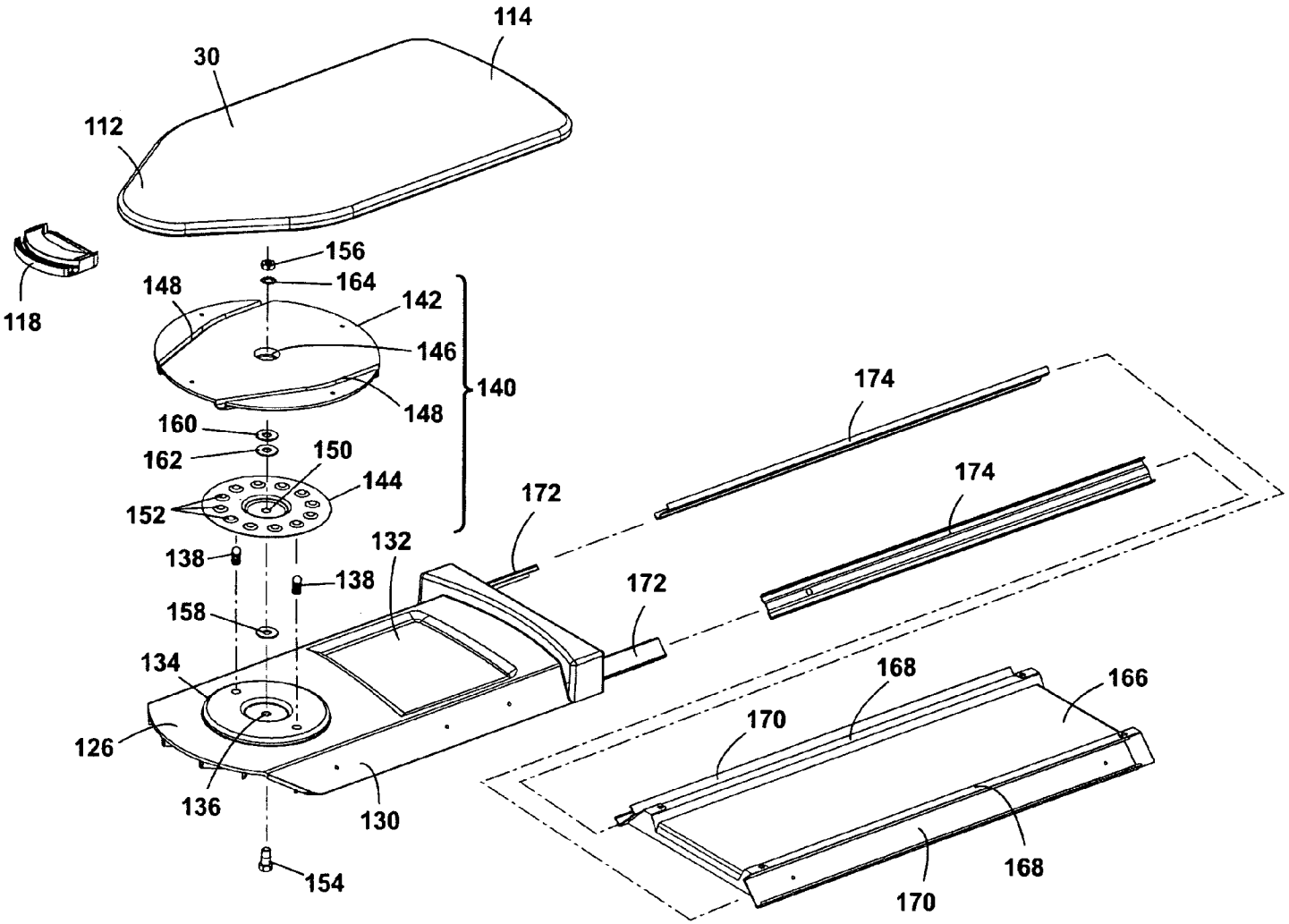
FIG. 15 is an exploded view of the ironing board, a rotatable bracket assembly mounting the ironing board to a platform, and a base supporting the platform.
Figure 16:
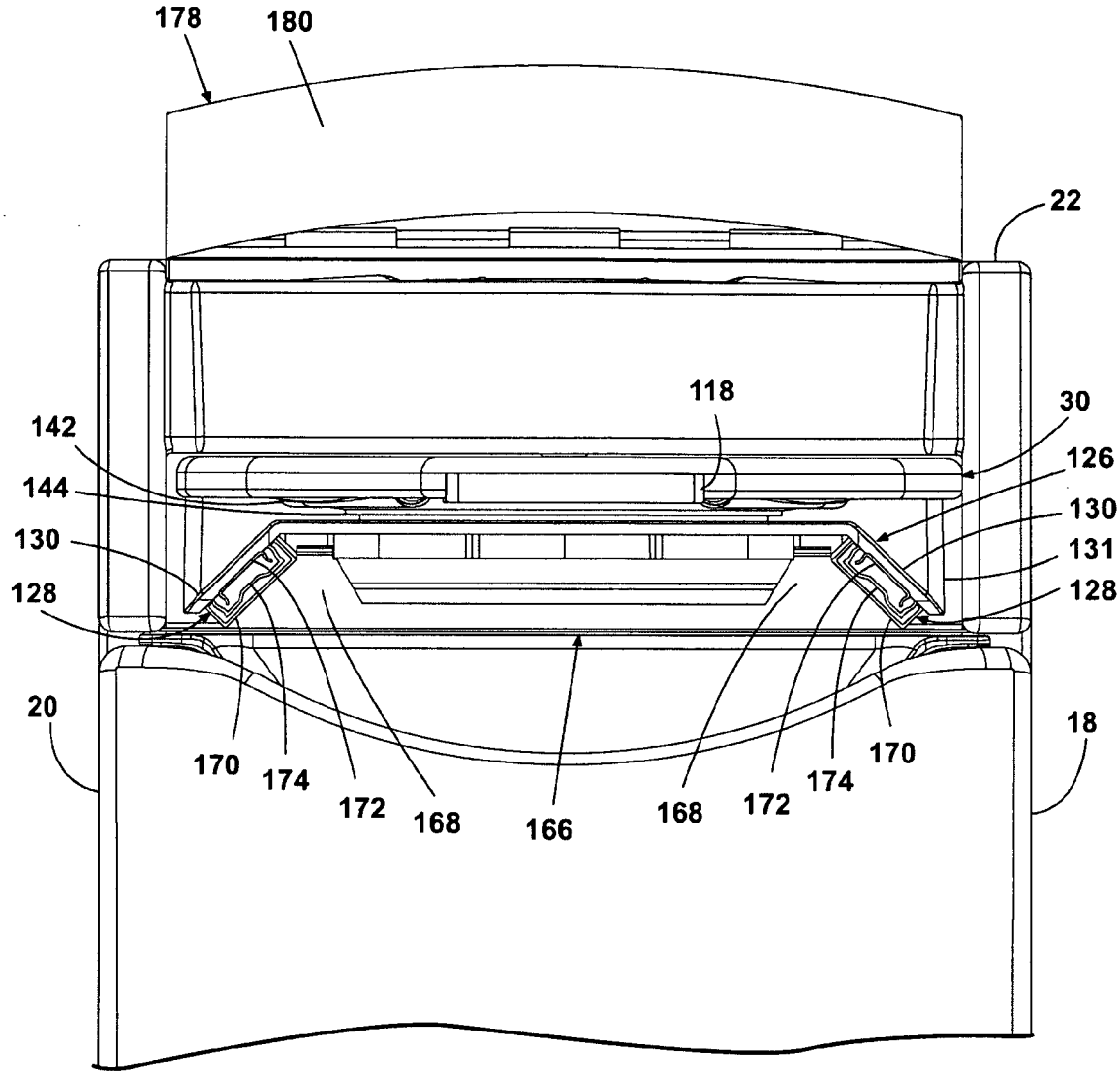
FIG. 16 is a front view of a portion of the ironing station from FIG. 12, with the cover in an opening position.

Referring to FIGS. 15 and 16, the ironing board 30 is carried by a platform 126 that movably supports the ironing board 30 for both translational and rotational movement. Two angled side segments 130 are included along the lateral sides of the platform 126 and a backstop 131 is included along a rear side of the platform 126. The platform 126 includes a storage recesses 132 formed on the rearward portion of the platform 126 and a raised plate receiver 134 formed on the forward portion of the platform 126. The raised plate receiver 134 includes a central opening 136 and two ball and spring plungers 138.

A rotatable bracket assembly 140 is mounted between the platform 126 and the ironing board 30 to effect the rotational movement of the ironing board 30 relative to the platform 126. Rotational movement of the ironing board 30 relative to the platform 126 allows the user to position the ironing board 30 in a desired orientation, and also allows access to the storage recess 132. The bracket assembly 140 includes an upper grooved plate 142 and a lower detent plate 144.

The grooved plate 142 includes a central opening 146 and two grooves 148 that receive the tapered end portion 122 of the reinforcement rod 120 to couple the ironing board 30 to the grooved plate 142 for rotation therewith. The detent plate 144 includes a central opening 150 and multiple detents 152 in which the ball and spring plungers 138 are received to releasably maintain the position of the bracket assembly 140. and therefore the ironing board 30, relative to the platform 126.

The platform 126, grooved plate 142 and detent plate 144 are connected together using any suitable fasteners, such that the grooved plate 142 and the detent plate 144 are fixed in relation to one another, and are rotatable in relation to the platform 126. As illustrated, a bolt 154 extends through the central openings 136, 146, 150 and is fastened above the grooved plate 142 by a nut 156. A first washer 158 is positioned between the platform 126 and the detent plate 144, second and third washers 160, 162 are positioned between the detent plate 144 and the grooved plate 142, and a fourth lock washer 164 is positioned between the grooved plate and the nut 156.

The platform 126 is further slidably mounted to a base 166 fixed within the pocket 112, such that the platform 126 slides through the front wall 14. The base 166 includes two lateral segments 168 having a generally trapezoidal configuration such that the lateral segments 168 have a similar slope as the angled side segments 130 of the platform 126. A pair of guide rails 128 slidably attach the platform 126 to the base 166. The guide rails 128 each comprise an outer stationary rail 170 mounted on one of the outer angled surfaces of the lateral segments 168, an inner stationary rail 172 mounted on the underside of one of the angled side segments 130 of the platform 126, and a moveable rail 174 that couples the outer stationary rail 170 to the inner stationary rail 172. The platform 126 can slide into and out of the pocket 112 relative to the base 166, which remains stationary within the interior space of the cabinet 12. Because the guide rails 128 are oriented at an angle, the base 166 has a lower profile than a similar base having slide members oriented vertically. This conserves space within the cabinet 12 for other purposes, such as for storage and for positioning of a docking station for an iron.

Figure 16A:
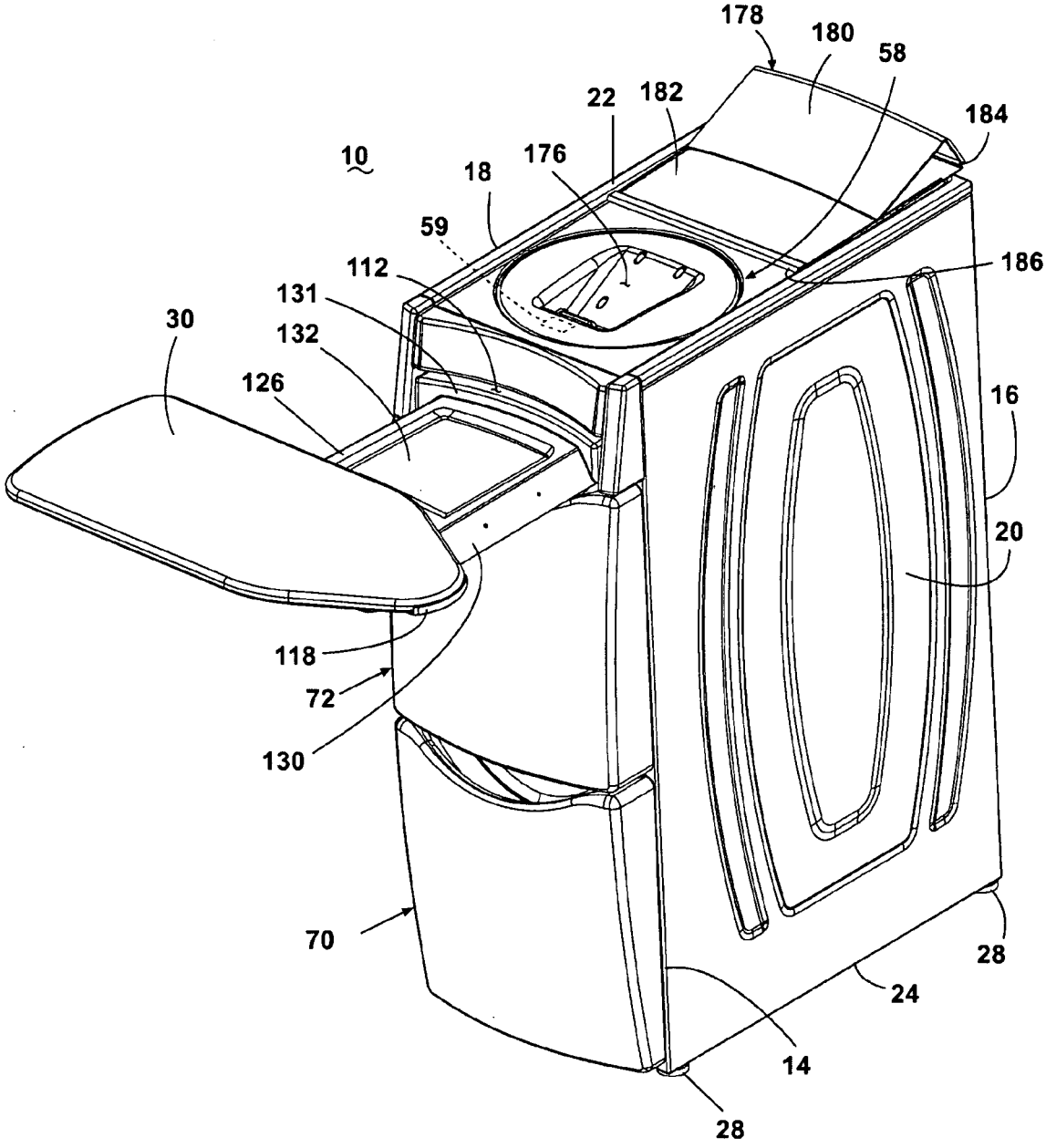
FIG. 16A is a close-up view of the ironing board from FIG. 13 shown in a pivoted position to illustrate a storage recess underneath the ironing board.

Referring to FIG. 16A, the ironing station 10 is further provided with a docking station 58 for receiving an iron 60. The docking station 58 is positioned on the top wall 22 of the cabinet 12 and comprises a power supply 59 to provide power to the iron 60. In this embodiment, the iron 60 is preferably a cordless iron that is recharged by the power supply 59 when received by the docking station 58. As shown in FIG. 16A, the docking station 58 includes a depressed cradle 176 that supports the iron 60 in an angled orientation. Maintaining the iron 60 in an angled orientation is more stable than maintaining the iron in an upright position, as shown for the first and second embodiments. Also, the iron 60 is supported in more ergonomic position, allow the user to comfortably reach for and remove the iron 60 from the docking station.

Referring to FIGS. 12 and 13, the ironing station 10 further comprises a cover 178 for selectively closing the opening of the pocket 112 and for selectively covering the docking station 58, when the ironing board 30 is in the stowed position and the iron 60 is not positioned on the docking station 58. The cover 178 is selectively movable between a closed position (FIG. 12) and an open position, where the ironing board 30 and the docking station 58 are available for use (FIG. 13).

In the present embodiment, the cover 178 includes a hood 180 joined to a movable cover panel 182 by a first hinge 184, the cover panel 182 in turn joined to the top wall 22 of the cabinet 12 by a second hinge 186. In the closed position (FIG. 12) the hood 180 is positioned in a generally vertical orientation over a portion of the front wall 14 to cover the ironing board pocket 112 and the cover panel 182 is positioned in a generally horizontal orientation over a portion of the top wall 22 to cover the docking station 58. In the open position (FIG. 13) the hood 180 and the cover panel 182 are folded back over the top wall 22, exposing the ironing board pocket 112 and the docking station 58. To move the cover 178 from the closed position to the open position, the hood 180 is pivoted upwardly about the first hinge 184, and both the hood 180 and cover panel 182 are folded back over the top wall 22 by rotation about the second hinge 186.

It is contemplated that the hood 180 may be eliminated, so that the cover 178 selectively covers only the docking station 58, leaving the opening of the pocket 112 exposed. This would allow the ironing board 30 to be accessed, while leaving the docking station 58 covered.

Referring to FIGS. 12, 13 and 16A, to move the ironing board 30 from the stowed position (FIG. 12) to the use position (FIGS. 13 and 16A), the cover 178 is first moved to the open position to expose the handle 118. Then, by pulling the handle 118 on the ironing board 30, the platform 126 is extended outwardly from the cabinet 12 along the guide rails 128. The ironing board is then rotated to any desired angle with respect to the platform 126. One exemplary position is illustrated in FIG. 16A, in which the ironing board 30 is rotated 90° from the position illustrated in FIG. 13. The storage recess 132 can be accessed in the exemplary position illustrated in FIG. 16A. It is understood from the forgoing description that the use position can comprise any orientation of the ironing board 30 in which the user can utilize the ironing board 30 for ironing purposes.

Figure 17:
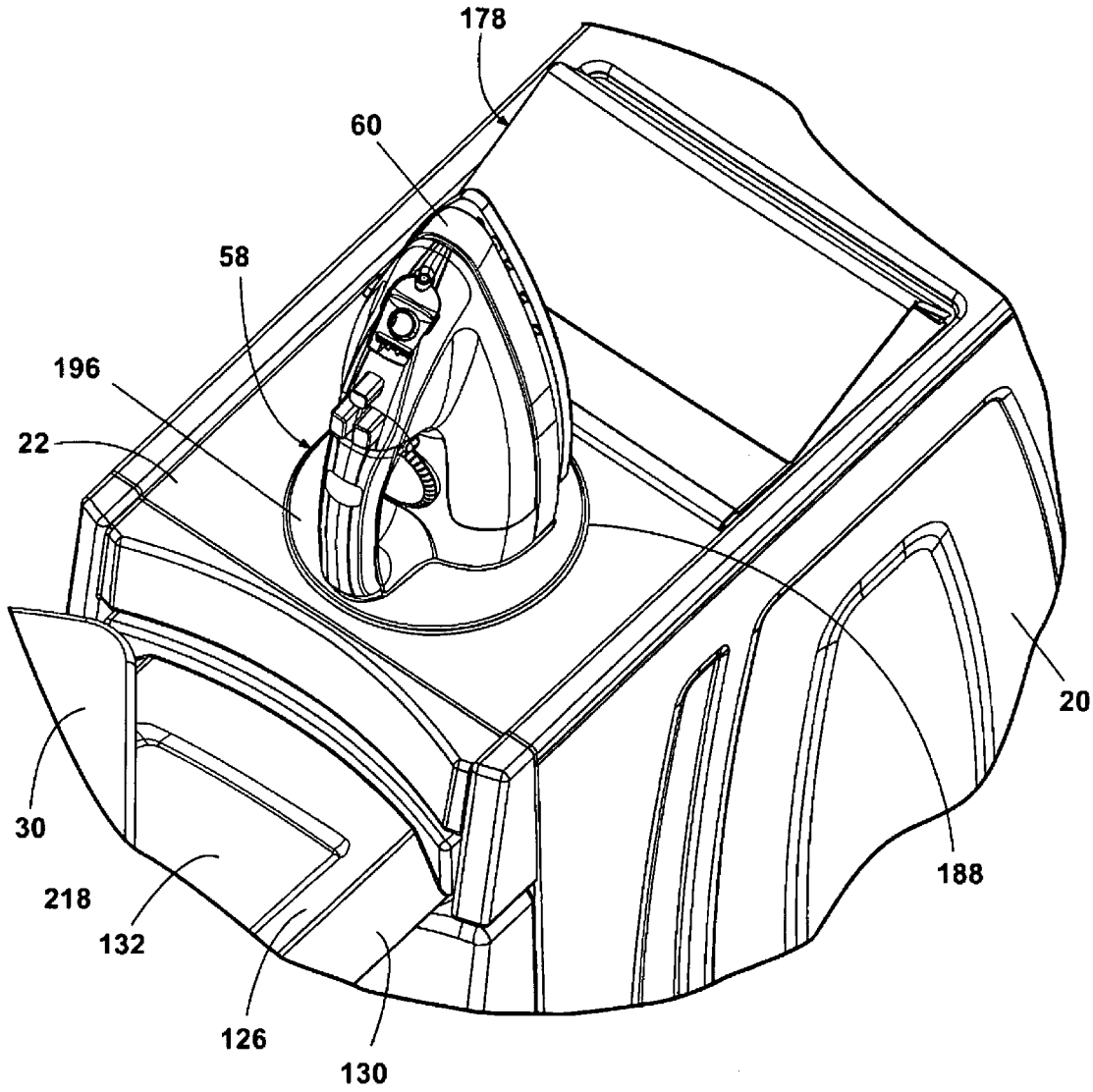
FIG. 17 is a close-up perspective view of a portable ironing station according to a fourth embodiment of the invention, illustrating a multi-position docking station.

According to a fourth embodiment of the invention shown in FIG. 17, where elements similar to those of the previous embodiments are identified by the same reference numerals, the fourth embodiment ironing station 10 is generally the same as the third embodiment. The main differences between the third and fourth embodiments lie in the configuration of the docking station 58, in that the docking station 58 provided is a multi-position docking station for docking the iron 60 in different orientations. The docking station 58 can be rotatably coupled to the top wall 22 to effect movement of the iron 60 between different orientations.

Figure 18:
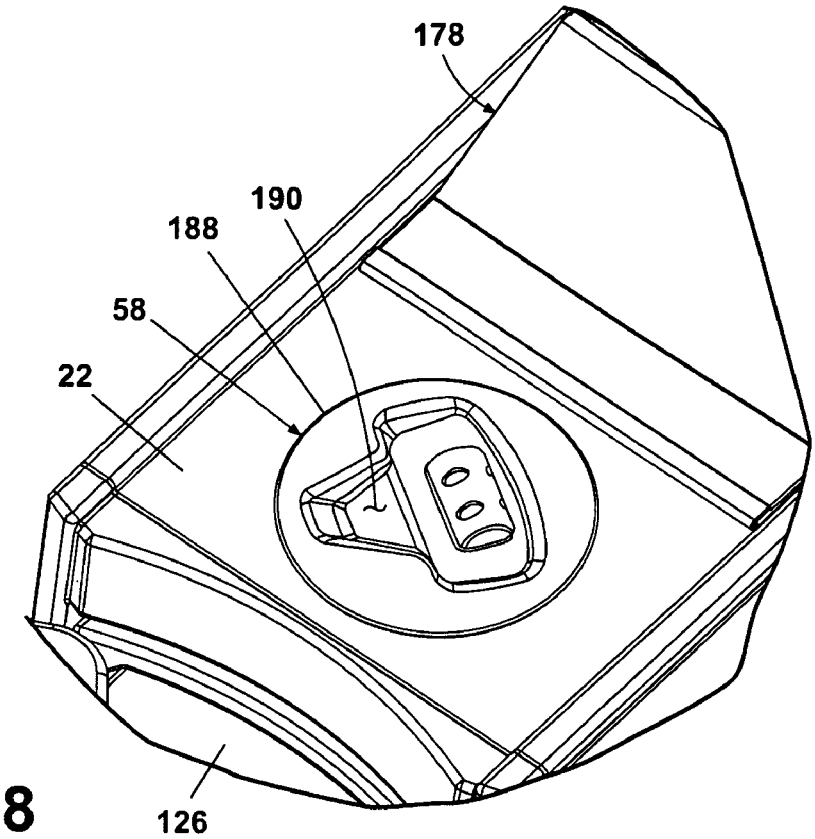
FIGS. 18 and 19 are views illustrating two different exemplary orientations of the multi-position docking station from FIG. 17.
Figure 19:
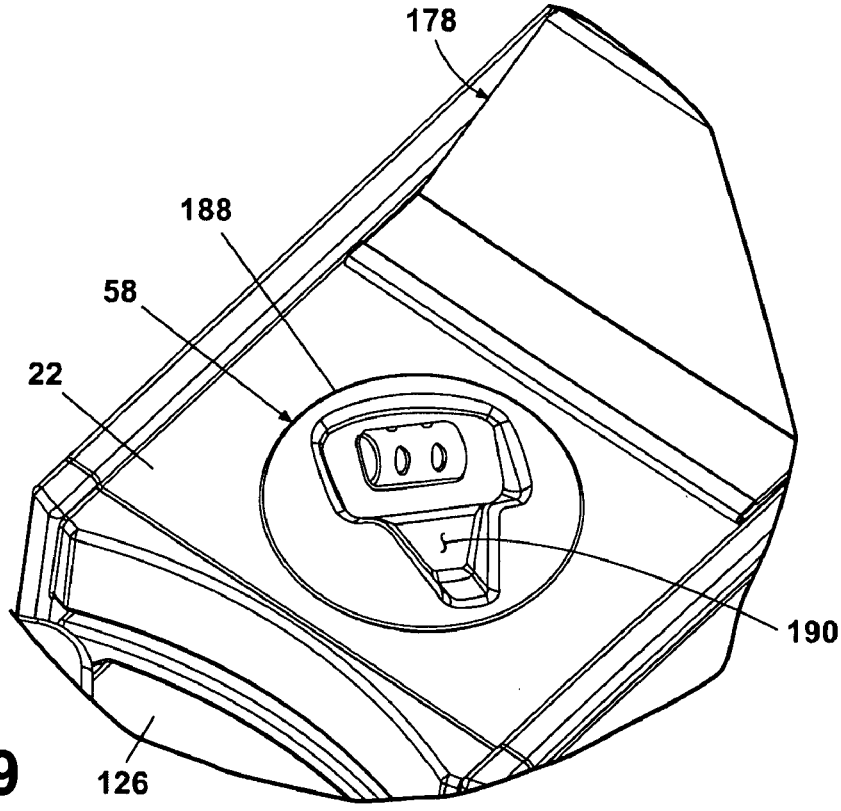

Referring to FIGS. 18 and 19, two exemplary orientations of the docking station 58 are shown. It is contemplated that the docking station 58 can be configured to be moveable between at least two discrete orientations, such as the orientations shown. It is also contemplated that the docking station 58 can be configured to be moveably between an infinite number of variable orientations. The docking station 58 can be configured to have a limited range of movement, such as 90°, or could be configured to rotate freely through 360° of movement.

Figure 20:
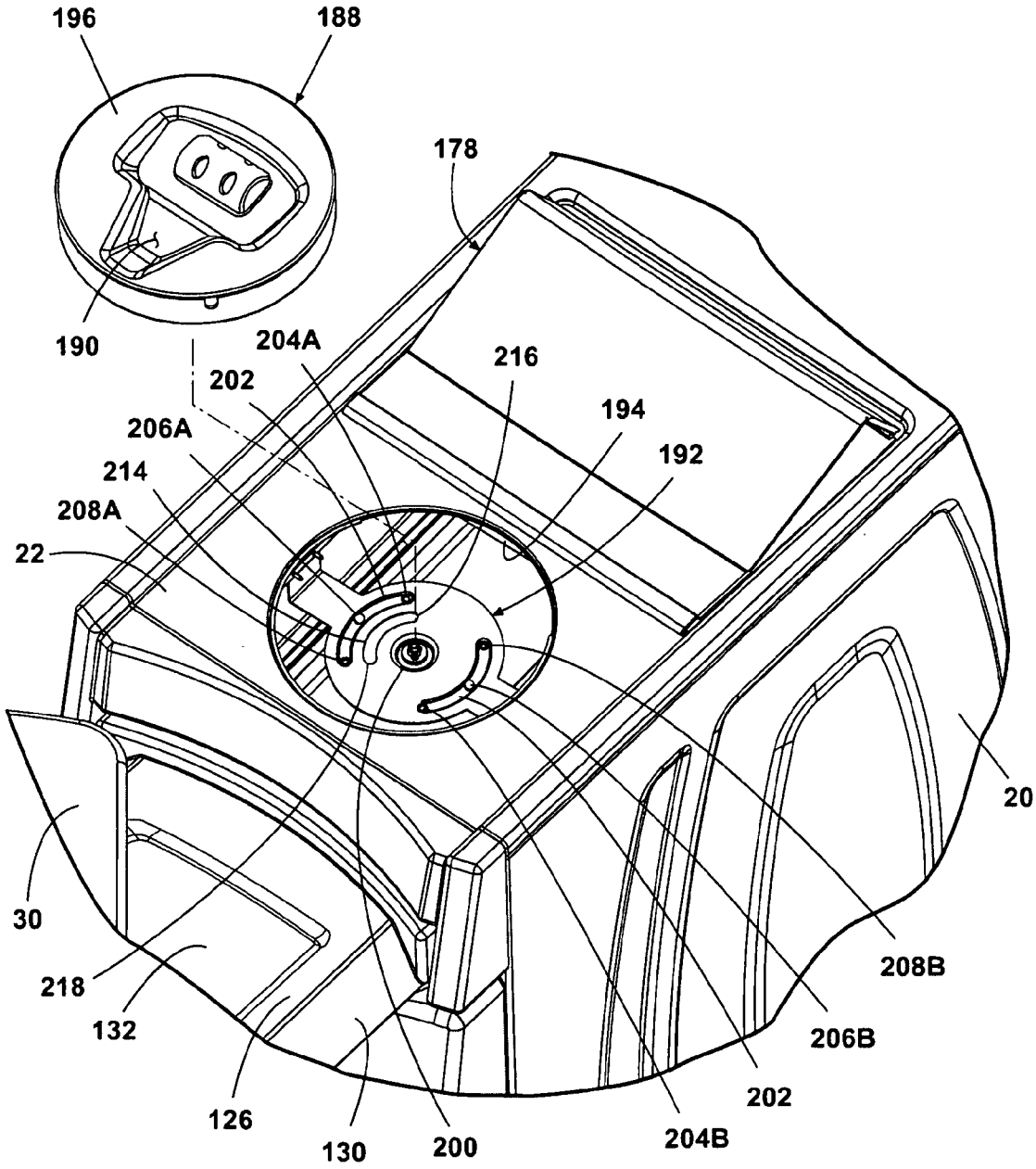
FIG. 20 is an exploded view of the multi-position docking station from FIG. 17.
Figure 21:
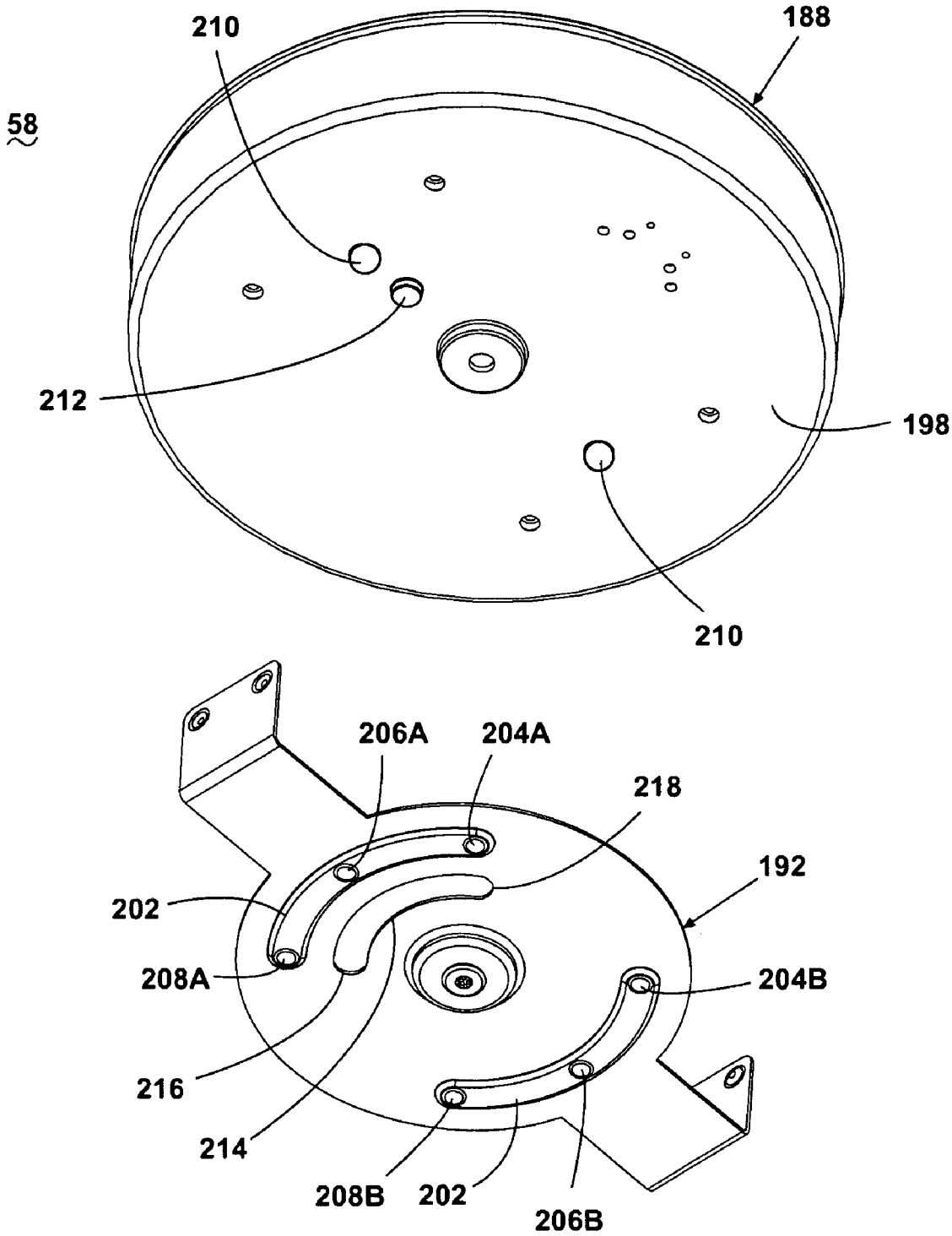
FIG. 21 is an exploded view of the multi-position docking station from a bottom perspective.

One possible configuration of the multi-position docking station 58 is shown in FIGS. 20 and 21. Referring to FIG. 20, the docking station 58 comprises a circular, rotating docking platform 188 having a recessed cradle 190 for receiving a cordless iron 60. The docking platform 188 is rotatably received by a docking bracket 192 positioned in an opening 194 formed in the top wall 22. The size of the opening 194 corresponds to the size of the docking platform 188, so that a top surface 196 of the docking platform 188 is generally flush with the top wall 22 when assembled. The docking bracket 192 allows the docking platform 188 to rotate to position the recessed cradle 190 in multiple different orientations relative to the front wall 14. This allows the iron 60 to be comfortably removed from or placed on the docking station 58 from different locations by different users, such as by a left- or right-handed user or from either side of the extended ironing board 30.

Referring to FIGS. 20 and 21, the docking bracket 192 includes a connector 200 for attachment to a lower surface 198 of the docking platform 188 to rotatably couple the docking platform 188 to the docking bracket 192. Two arcuate bearing tracks 202 are positioned on opposite sides of the connector 200, each of which has three spaced bearing recesses 204A/B, 206A/B, 208A/B. The bearing recesses 204A, 204B are diametrically opposite each other and form a first end pair of bearing recesses. The bearing recesses 206A, 206B are also diametrically opposite each other and form a middle pair of bearing recesses. The bearing recesses 208A, 208B are also diametrically opposite each other and form a second end pair of bearing recesses. A pair of ball bearings 210 are provided on the lower surface 198 of the docking platform 188, and each ball bearing 210 rides in one of the bearing tracks 202 and can be selectively received within one of the pairs of bearing recesses.

Each pair of bearing recesses 204A/B, 206A/B, 208A/B corresponds to a discrete orientation of the docking station 58. In use, the docking platform 188 can be rotated relative to the docking bracket 192 so that the ball bearings 210 are received in one of the pairs of bearing recesses 204A/B, 206A/B, 208A/B to maintain the docking platform 188 in one of the discrete orientations. For example, the orientation shown in FIG. 18 can correspond to the condition where the ball bearings 210 are received in the first end pair of bearing recesses 204A, 204B, and the orientation shown in FIG. 19 can correspond to the condition where the ball bearings 210 are received in the second end pair of bearing recesses 208A, 208B.

A stop 212 protrudes from the lower surface 198 of the docking platform 188 and rides in a arcuate stop track 214 formed in the docking bracket 192 and positioned between the connector 200 and one of the bearing tracks 202. The stop track 214 has two stop ends 216, 218 which can be engaged by the stop 212 to prevent further rotation of the docking platform 188 relative to the docking bracket 192. The stop 212 prevents the docking platform 188 from being "over-rotated" in that the stop 212 engages one of the stop ends 216, 218 when the ball bearings 210 are received in either end pair of bearing recesses 204A/B, 208A/B.

According to a fifth embodiment of the invention shown in FIGS. 22-28C, where elements similar to those of the previous embodiments are identified by the same reference numerals, the fifth embodiment ironing station 10 is generally the same as, and comprises generally the same outward appearance as, the fourth embodiment. The main differences between the fourth and fifth embodiment lie in the configuration of the ironing board 30 and the arrangement for supplying power to an iron, or other electrical device.

Figure 25:
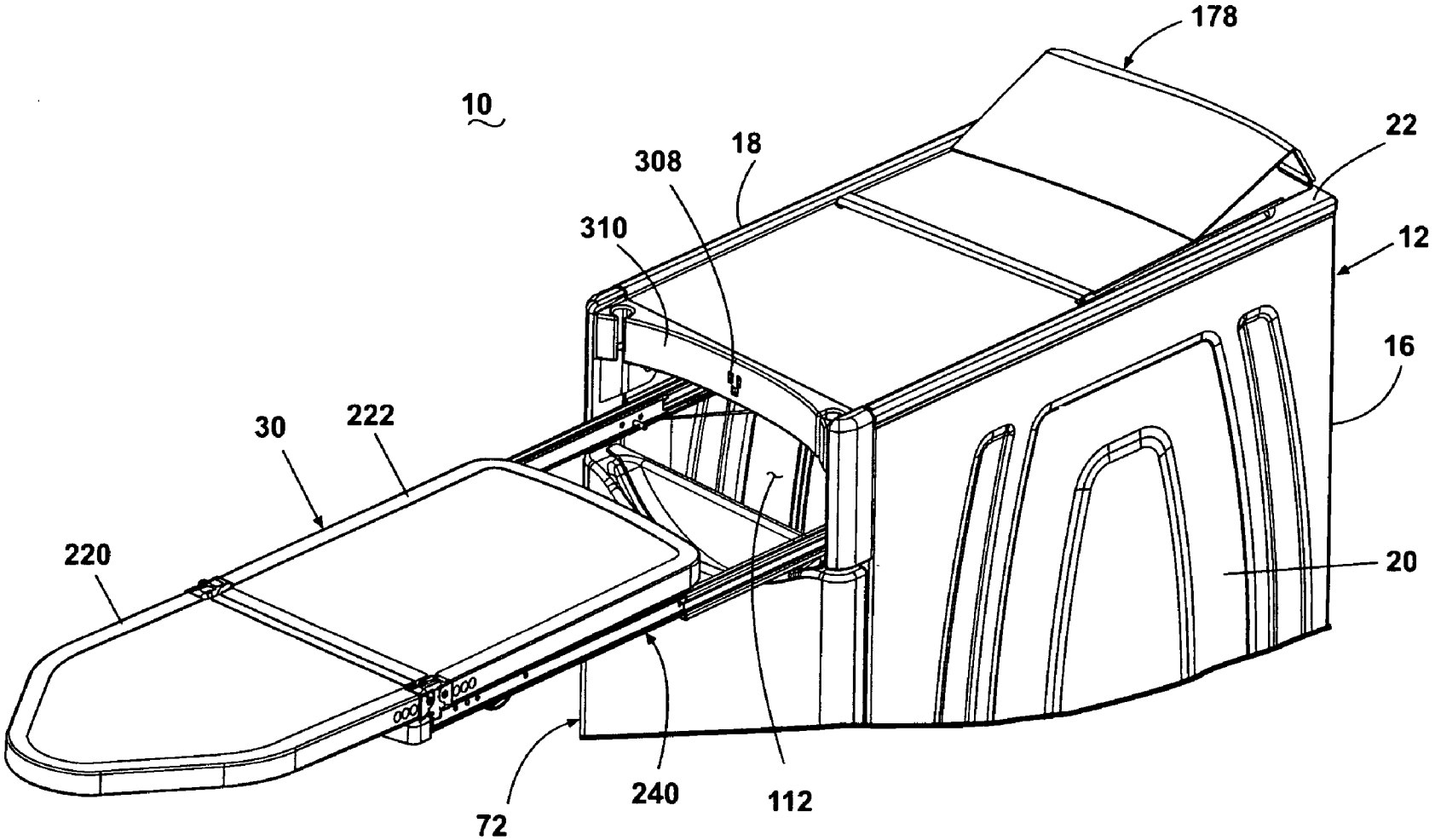
FIG. 25 is a perspective view of the ironing station from FIG. 22, with the ironing board in a second use position.
Figure 26:
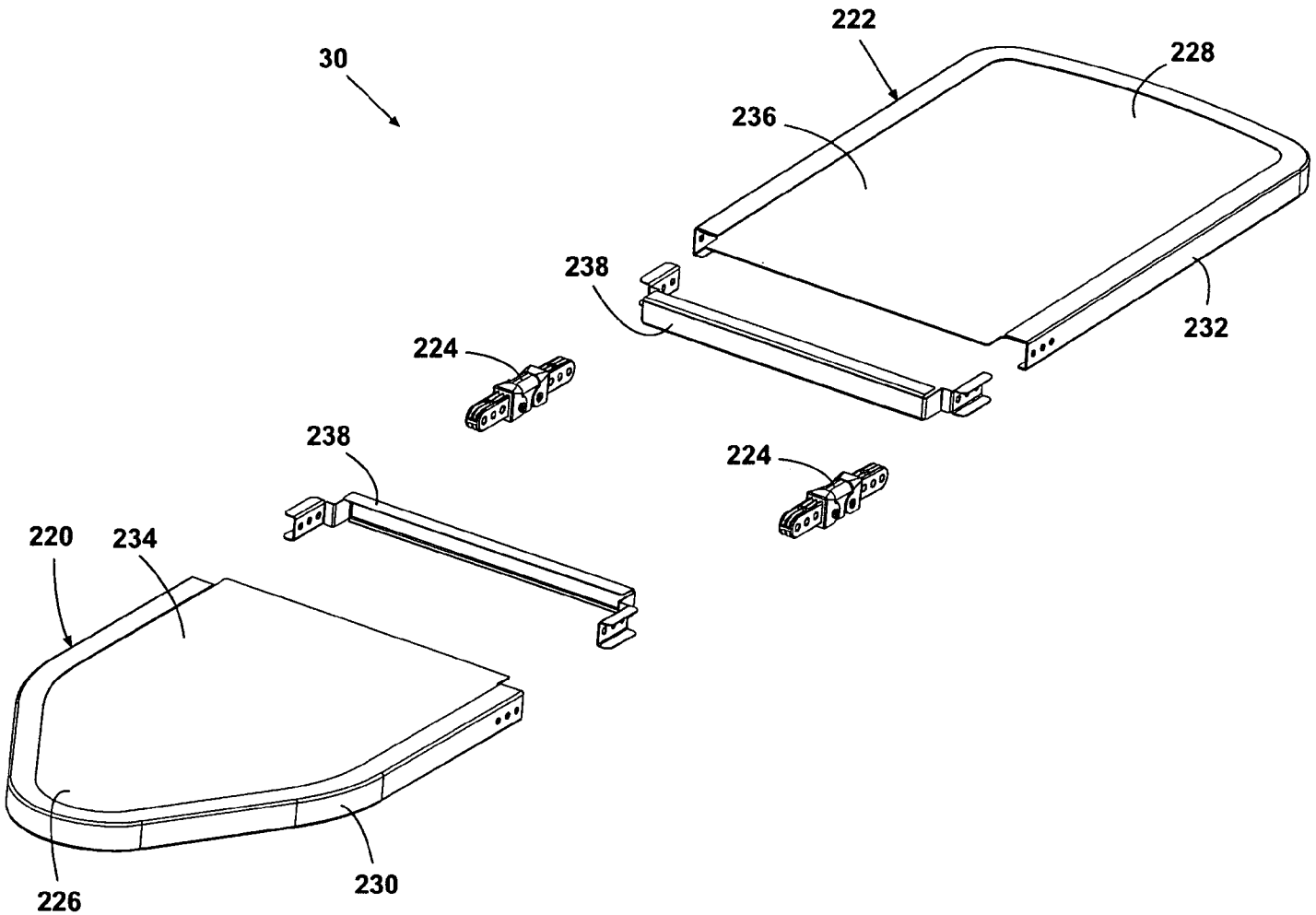
FIG. 26 is an exploded view of the ironing board from FIG. 22.

Referring to FIGS. 25 and 26, the ironing board 30 comprises a forward leaf 220 and a rear leaf 222 that are pivotally joined by a pair of hinges 224 so that the forward leaf 220 can be folded back over the rear leaf 222 to an orientation in which it overlies the rear leaf 222. The ironing board 30 can have a typical shape, with a tapered end 226 formed on the forward leaf 220, and a blunt end 228 formed on the rear leaf 222. In one contemplated embodiment, the forward and rear leaves 220, 222 can each comprise a respective frame 230, 232 supporting a respective mesh insert 234, 236. The frames 230, 232 are joined together by the hinges 224 and two support ribs 238 that extend between the hinges 224, and can be fastened together using rivets or other suitable fasteners. An ironing board pad and/or cover (not shown) can optionally be placed over the ironing board 30.

Figure 22:
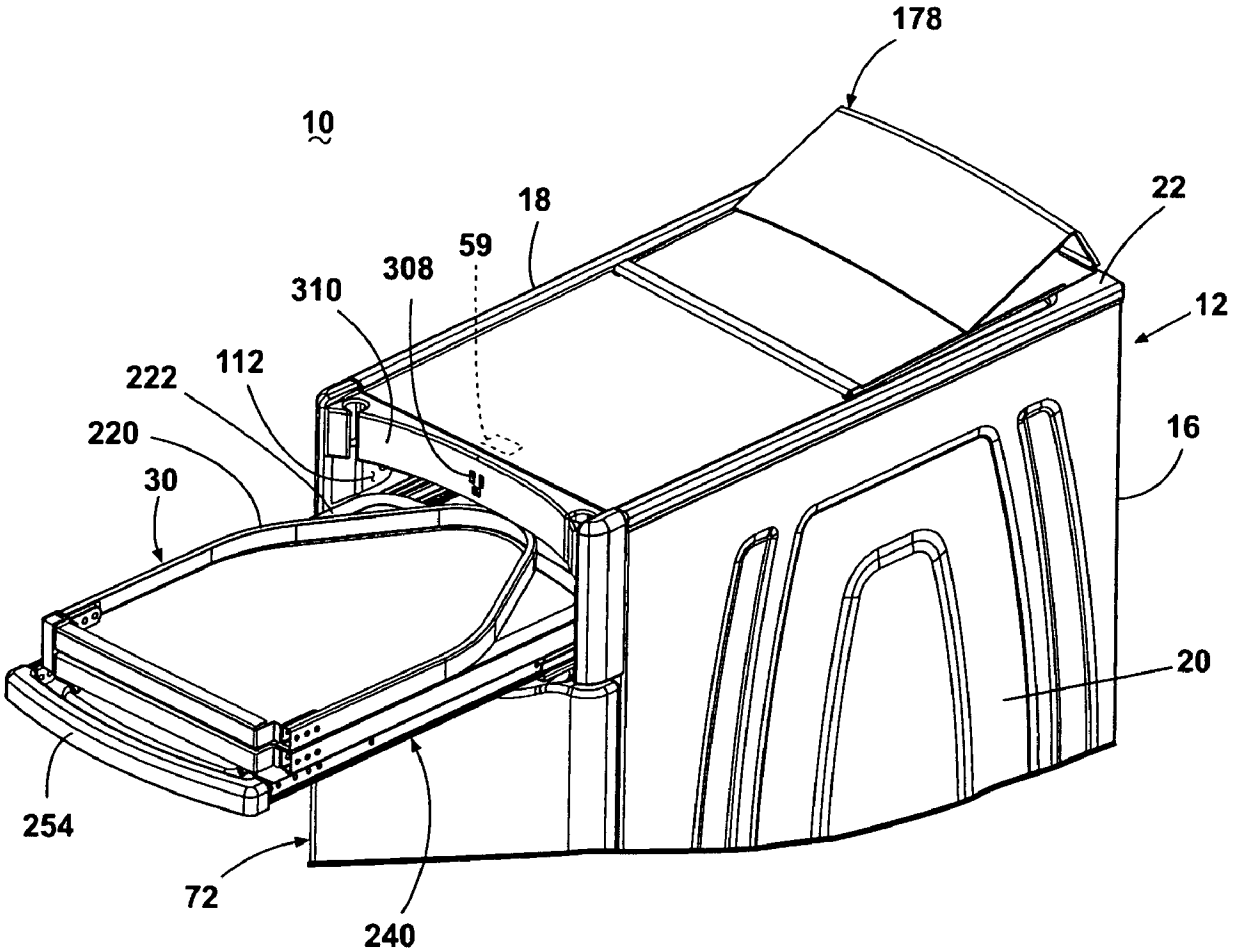
FIG. 22 is a perspective view of a portable ironing station according to a fifth embodiment of the invention, with a cover in an open position and an ironing board in a first intermediate position.
Figure 23:
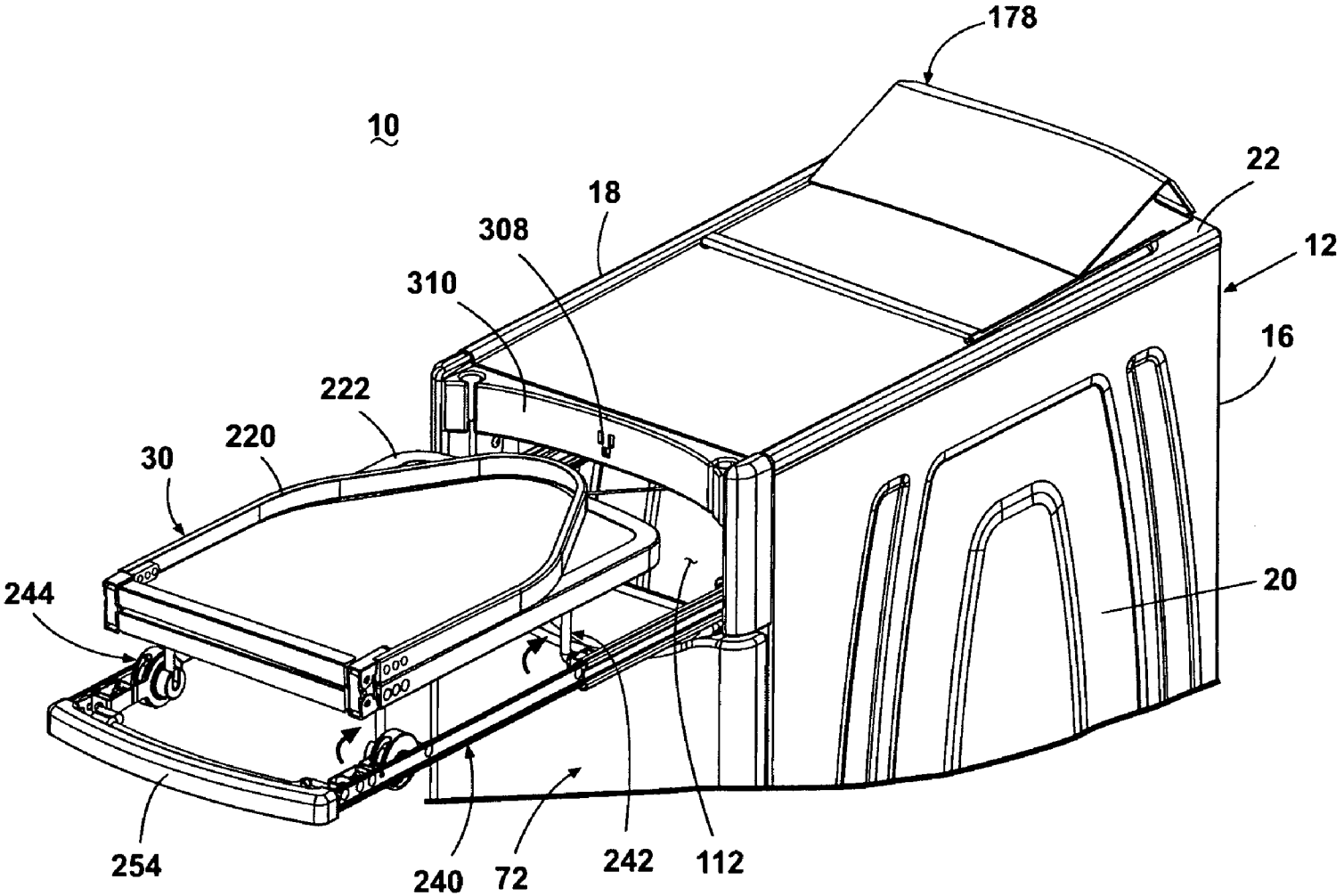
FIG. 23 is a perspective view of the ironing station from FIG. 22, with the ironing board in a second intermediate position.
Figure 24:
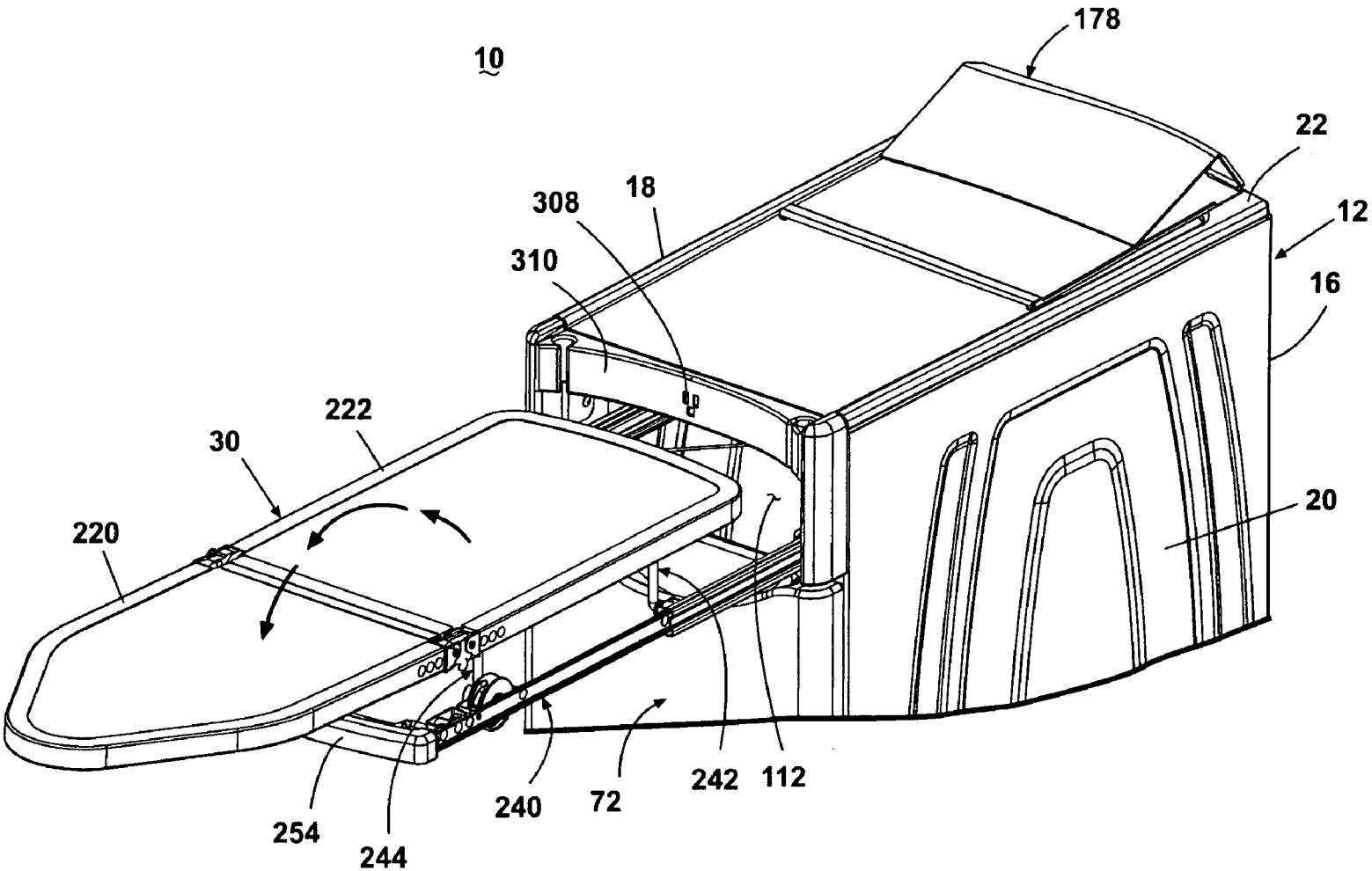
FIG. 24 is a perspective view of the ironing station from FIG. 22, with the ironing board in a first use position.

Referring to FIGS. 22-25, the ironing board 30 can be coupled to an ironing board support 240, which is in turn coupled to the cabinet 12. The ironing board support 240 can slidingly couple the ironing board 30 to the cabinet 12 so that the ironing board 30 can be selectively moved into and out of the pocket 112 formed in the interior space of the cabinet 12. The ironing board 30 can be selectively moveable between a stowed position (not shown) where the ironing board 30 is received within the pocket 112, and a use position where the ironing board 30 can be utilized for ironing purposes (FIGS. 24-25). The stowed position of the fifth embodiment is similar to the stowed position of the third and fourth embodiments, except that in the stowed position of the fifth embodiment, the forward leaf 220 overlies the rear leaf 222.

The ironing board 30 is moved through at least one intermediate position (FIG. 22-23) when moving between the stowed and use positions. Two possible intermediate positions are illustrated herein. In the first intermediate position shown in FIG. 22, the ironing board 30 has been moved out of the pocket 112 and the forward leaf 220 still overlies the rear leaf 222. In the second intermediate position shown in FIG. 23, the ironing board 30 has been raised or elevated with respect to the ironing board support 240, with the forward leaf 220 still overlying the rear leaf 222.

In the use position, the forward leaf 220 and the rear leaf are unfolded 222 and are substantially even with each other to form a continuous surface for ironing. A first use position or elevated use position is shown in FIG. 24, in which the ironing board 30 is raised with respect to the ironing board support 240. In the first use position, the ironing board may be slightly below the top surface 22 of the cabinet 12, as illustrated, or may be generally flush with the top surface 22. A second use position or a lowered use position is shown in FIG. 25, in which the ironing board 30 is not raised with respect to the ironing board support 240.

Figure 27:
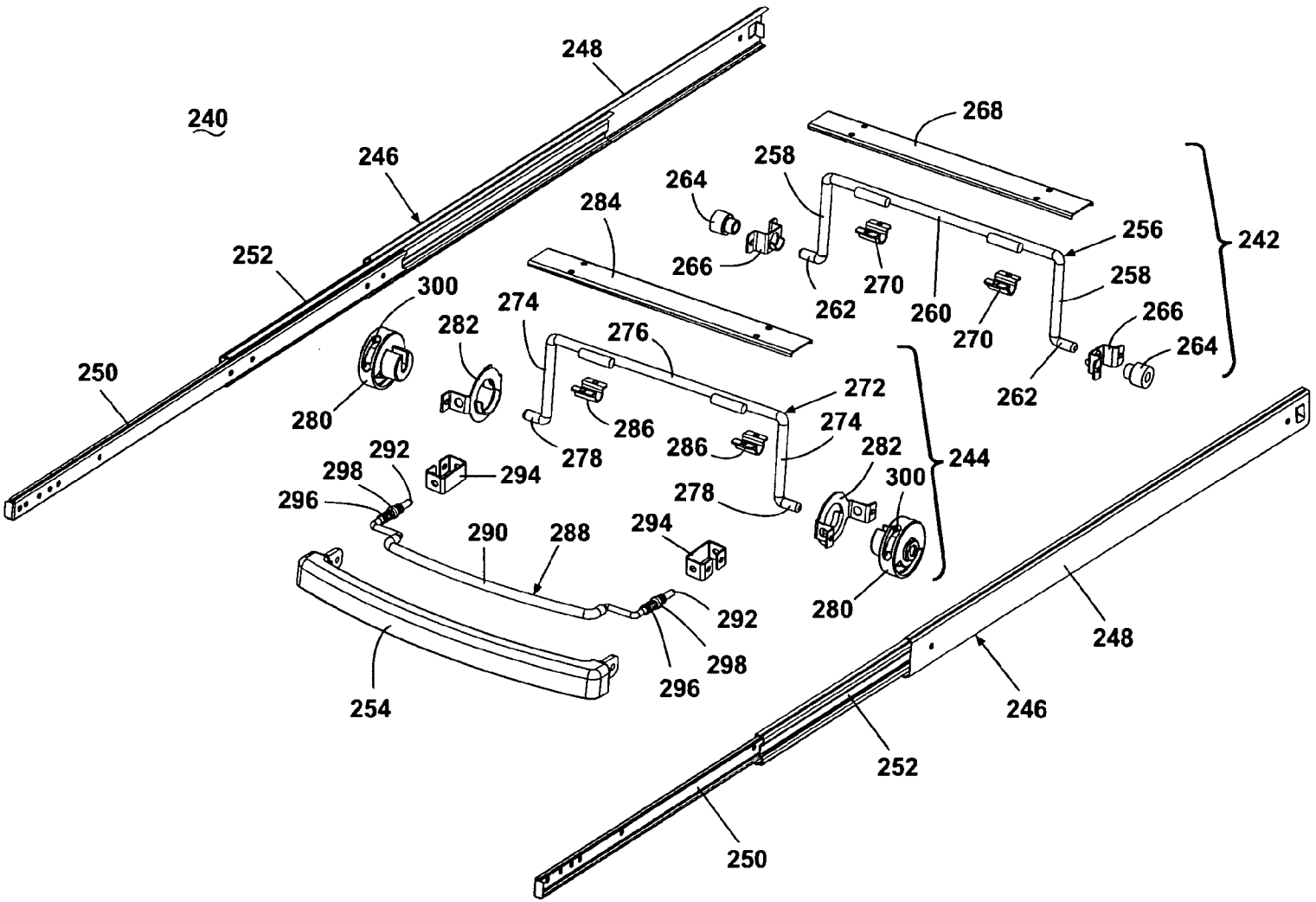
FIG. 27 is an exploded view of an ironing board support for the ironing board from FIG. 22, the ironing board support including a front crankshaft assembly, a rear crankshaft assembly and a latch mechanism.

Referring to FIG. 27, as illustrated herein, the ironing board support 240 comprises a pair of guide rails 246 that are slidably attached to the cabinet 12. Each guide rail 246 comprises an outer stationary rail 248 mounted on one of the inner surfaces of the left and right side walls 14, 16, an inner stationary rail 250 mounted to the crankshaft assemblies 242, 244, and a moveable rail 252 that couples the outer stationary rail 248 to the inner stationary rail 250. A handle 254 is attached to the ends of the inner stationary rails 250 and can be gripped by a user to move the ironing board 30 in and out of the pocket 112.

The ironing board support 240 may be further provided with an elevation mechanism that operably couples the ironing board 30 to the ironing board support 240 to raise the ironing board 30 to an elevated position with respect to the ironing board support 240, as illustrated in FIG. 23 or 24. As illustrated herein, the elevation mechanism may have two crankshaft assemblies 242, 244 coupled to the inner stationary rail 250 of the guide rails 246. The first or rear crankshaft assembly 242, which is positioned closer to the blunt 228 end of the ironing board 30, comprises a generally U-shaped crankshaft 256 having two legs 258 extending orthogonally from a center rod 260. The end of each leg 258 comprises a foot 262 extending relatively parallel to the center rod 260. The crankshaft 256 is rotatably mounted to the inner stationary rails 250 by bushings 264 attached to each foot 262 that are supported within bushing holders 266 fixed to the inner stationary rails 250. The crankshaft 256 is mounted to the rear leaf frame 232 on the underside of the rear leaf 222 via a brace 268 that is attached to the crankshaft 256 by two spaced brace brackets 270 that wrap around the center rod 260 and fasten to the brace 268.

The second or forward crankshaft assembly 244, which is positioned closer to the tapered end 226 of the ironing board 30, comprises a generally U-shaped crankshaft 272 having two legs 274 extending orthogonally from a center rod 276. The end of each leg 274 comprises a foot 278 extending relatively parallel to the center rod 276. The crankshaft 272 is rotatably mounted to the inner stationary rails 250 by bushings 280 attached to each foot 278 that are supported within bushing holders 282 fixed to the inner stationary rails 250. The crankshaft 272 is mounted to the forward leaf frame 230 on the underside of the forward leaf 220 via a brace 284 that is attached to the crankshaft 272 by two spaced brace brackets 286 that wrap around the center rod 276 and fasten to the brace 284.

Figure 28A:
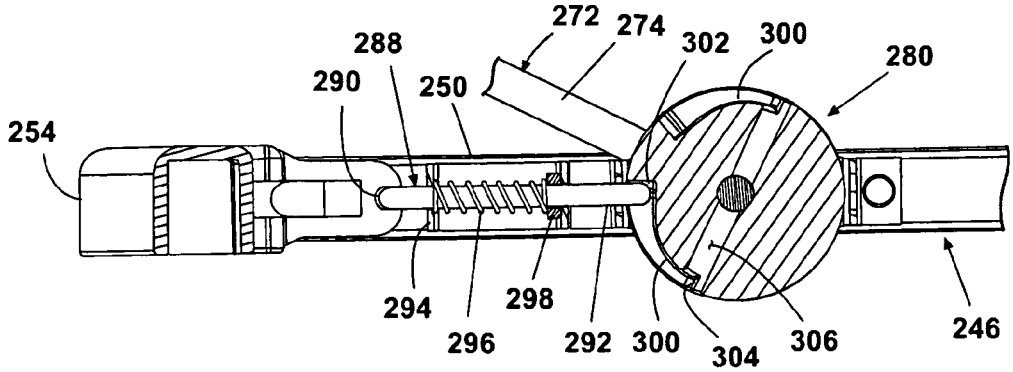
FIG. 28A is a sectional view through the front crankshaft assembly and the latch mechanism, with the ironing board in a lowered position.
Figure 28B:
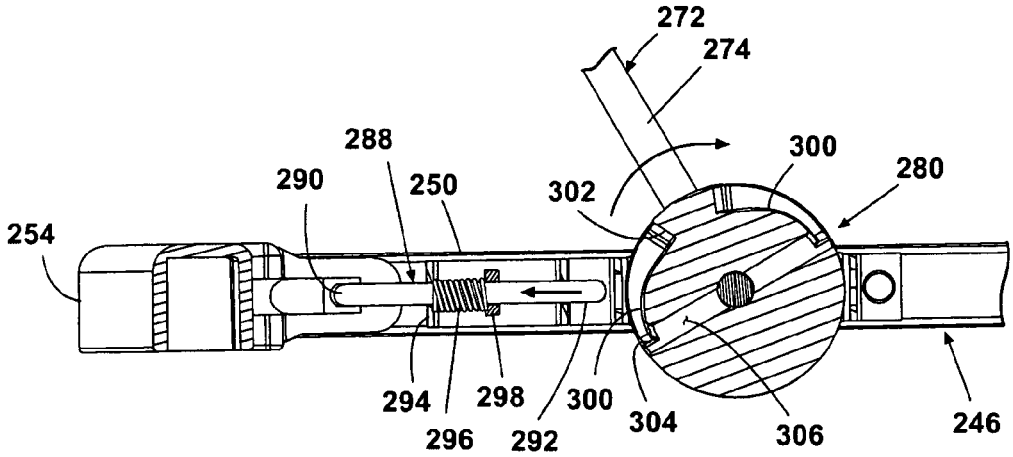
FIG. 28B is a sectional view through the front crankshaft assembly and the latch mechanism, with the ironing board moving between the lowered position and a raised position.
Figure 28C:
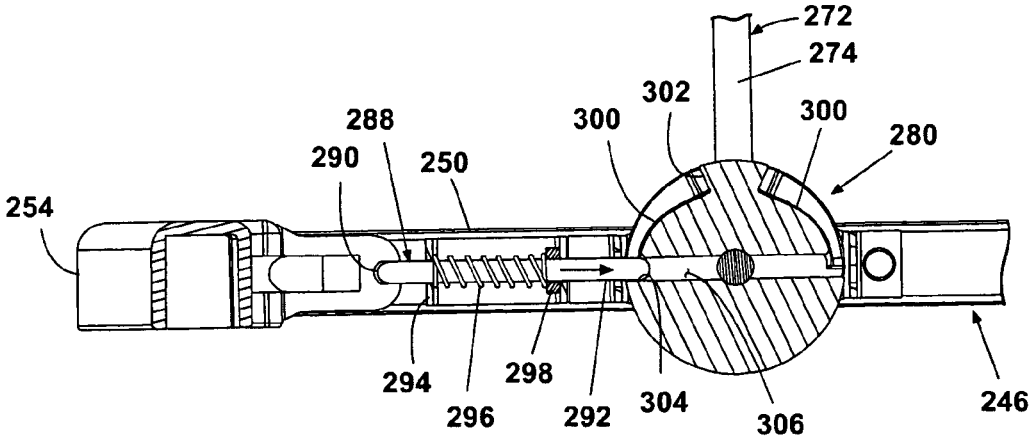
FIG. 28C is a sectional view through the front crankshaft assembly and the latch mechanism, with the ironing board in the raised position.

Referring to FIGS. 27-28C, the forward crankshaft assembly 244 further comprises a latch mechanism that can be used to releasably lock the ironing board 30 in the elevated position with respect to the ironing board support 240, as illustrated in FIG. 23 or 24. The latch mechanism may have a keeper carried by either the elevation mechanism or the ironing board support 240 and a moveable latch carried by the other of the elevation mechanism and the ironing board support 240. The keeper receives the latch to fix the ironing board 30 in the elevated position. The latch is moveable relative to the keeper to release the latch mechanism and allow the ironing board 30 to be lowered. The latch can comprise a user-actuable release the selectively engages the keeper.

As illustrated herein, the keeper comprises the bushings 280 and the latch comprises a latch wire 288 that selectively engages the bushings 280. The latch wire 288 comprises a grip portion 290 connected at either end to a latch pin 292. Each latch pin 292 is received by a latch bracket 294 that is mounted to the inner stationary rail 250 to slidably couple the latch wire 288 to the ironing board support 240. Each latch pin 292 is surrounded by a spring 296 that biases the latch wire 288 toward the bushings 280. The spring 296 can be positioned within the confines of the latch bracket 294 so that the movement of the latch wire 288 relative to is limited to prevent the latch wire 288 from extending out of the latch bracket 294. A stop 298 can be positioned around each latch pin 292 within the confines of the latch bracket 294 so that the spring 296 is positioned between a portion of the latch bracket 294 and the stop 298.

The end of the latch pin 292 are received by the bushings 280 in the raised and lowered positions. Each bushing 280 comprises an elongated groove 300 in its peripheral surface, the groove comprising a first stop end 302 and a second stop end 304 and becoming progressively shallower from the first stop end 302 to the second stop end 304. The bushing 280 may be provided with two such grooves 300 so that the same bushing can be used for either side of the crankshaft assembly 244 to simplify assembly of the ironing station 10. In the lowered position, shown in FIG. 28A, the latch pin 292 is received in the groove 300 near the first stop end 302. In the raised position, shown in FIG. 28C, the latch pin 292 is received in the groove near the second stop end 304. The second stop end 304 may further comprise a detent 306 for securely locking the ironing board 30 in the raised position. The detent 306 may formed as a channel extending through the bushing 280 so that the same bushing can be used for either side of the crankshaft assembly 244.

Referring to FIGS. 28A-C, the orientation of the latch mechanism when moving the ironing board 30 between the lowered and raised positions is illustrated. In the lowered position, shown in FIGS. 22 and 28A, the latch pins 292 are received in the groove 300 of the bushings 280 at the first stop end 302. To move from the lowered position to the raised position, the latch wire 288 is pulled away from the bushings 280, as shown in FIG. 28B, so that the end of the latch pins 292 clear the groove 300, allowing the ironing board 30 to be raised by rotating the crankshaft assemblies 242, 244 about their respective bushings 264, 280. In the raised position, shown in FIGS. 23 and 28C, the latch pins 292 are received in the detent 306 at the second stop end 304 by releasing the latch wire 288, thereby fixing the ironing board 30 in the elevated position. To move the ironing board 30 from the raised position to the lowered position, the latch wire 288 is pulled away from the bushings 280, as shown in FIG. 28B, so that the end of the latch pins 292 clear the detent 306, allowing the ironing board 30 to be lowered by rotating the crankshaft assemblies 242, 244 about their respective bushings 264, 280.

As an alternative, the ironing board 30 may be fixed in the elevated position automatically simply by raising the ironing board 30. As the crankshaft assemblies 242, 244 are rotated about their respective bushings 264, 280, the latch pins 292 ride in grooves 300 from the first stop end 302 toward the second stop end 304. As the grooves 300 becomes shallower toward the second stop end 304, the springs 296 will compress, until the latch pins 292 reach the detent 306, at which time the latch pins 292 will move into the detent 306 by spring force.

Referring to FIG. 22, the ironing station 10 is further provided with an electrical outlet 308 coupled to a power supply 59 to provided power to an electrical device, such as a corded iron. The power supply 59 can be mounted to the cabinet 12 or can be separate from the cabinet 12. In the illustrated embodiment, the electrical outlet 308 is provided on a bowed panel piece 310 provided on the front wall 14 of the cabinet 12, above the pocket 112. Due to the curvature of the bowed panel piece 310, there is sufficient room for a plug to be connected to the electrical outlet 308, even when the ironing board 30 is in the raised position. As illustrated, the electrical outlet 308 can only be accessed when the cover 178 is in the open position. It is contemplated that the electrical outlet 308 could be provided in a location in which it is accessible when the cover 178 is in the closed position as well.

Figure 29:
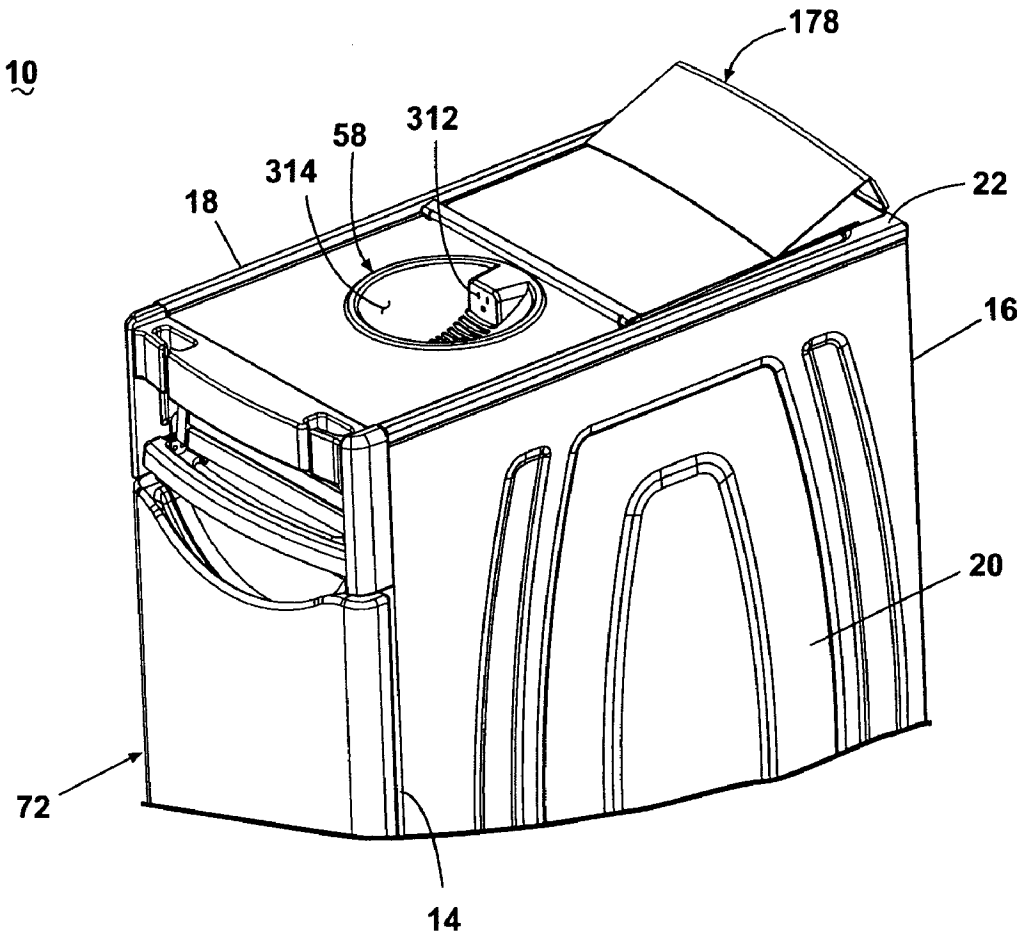
FIG. 29 is a perspective view of a portable ironing station according to a sixth embodiment of the invention.

According to a sixth embodiment of the invention shown in FIG. 29, where elements similar to those of the previous embodiments are identified by the same reference numerals, the sixth embodiment ironing station 10 is generally the same as the fifth embodiment. However, instead of providing an electrical outlet on the front wall 14, an electrical outlet 312 is provided on the top wall 22. The electrical outlet 312 is coupled to a power supply (not shown) to provided power to an electrical device, such as a corded iron (not shown). The power supply can be mounted to the cabinet 12 or can be separate from the cabinet 12. In the illustrated embodiment, the electrical outlet 312 is provided in a recess 314 formed in the top wall 22 of the cabinet 12, in a position where the recess 314 is covered by the cover 178 in the closed position. Thus, the electrical outlet 312 can only be accessed when the cover 178 is in the open position. It is contemplated that the electrical outlet 312 could be provided in a location in which it is accessible when the cover 178 is in the closed position as well.

While the invention has been specifically described in connection with certain specific embodiments thereof, it is to be understood that this is by way of illustration and not of limitation, and the scope of the appended claims should be construed as broadly as the prior art will permit.

What is claimed is:

1. An ironing station comprising:

a cabinet comprising spaced side walls connected by a top wall to at least partially define an interior space accessible through an open face of the cabinet;

a pocket formed in the interior space of the cabinet and accessed through the open face;

an ironing board having a first tapered end and a second end, and slidably mounted to the cabinet for selective movement between a stowed position, wherein at least a portion of the ironing board is received within the pocket and only the first tapered end of the ironing board is accessible to a user, and a use position wherein at least the first tapered end of the ironing board is outside the pocket; and a handle provided on the first tapered end for aiding a user in sliding the ironing board between the stowed position and the use position;

wherein a user grips the first tapered end by the handle to move the ironing board from the stowed position to the use position.

2. The ironing station according to claim 1, and further comprising a docking station provided on the top wall of the cabinet for receiving an iron.

3. The ironing station according to claim 2, and further comprising a cover moveably mounted to the cabinet for selectively covering at least one of the docking station and the ironing board when it is in the stowed position.

4. The ironing station according to claim 2 wherein the docking station comprises a power supply to provide power to the iron.

5. The ironing station according to claim 4, and further comprising a cordless iron.

6. The ironing station according to claim 1, and further comprising a support slidably mounted to the cabinet and carrying the ironing board to slidably mount the ironing board to the cabinet.

7. The ironing station according to claim 6 wherein the ironing board is mounted to the support for movement in at least one of a linear and rotational movement.

8. The ironing station according to claim 1, and further comprising a storage area defined within the interior space of the cabinet and accessible through the open face.

9. The ironing station according to claim 1, wherein, in the use position, the first tapered end and the second end of the ironing board are outside the pocket.

10. An ironing station comprising:

a cabinet comprising spaced side walls connected by a top wall to at least partially define an interior space accessible through an open face of the cabinet;

a base located within the interior space;

an ironing board stowably mounted to the cabinet for selective movement between a stowed position, wherein at least a portion of the ironing board is received within the interior space, and a use position; and at least one guide rail orientated at an angle other than vertical and slidably coupling the ironing board to the base to effect movement of the ironing board between the stowed position and the use position;

wherein the angle is 45°.

11. The ironing station according to claim 10, and further comprising a storage area defined within the interior space of the cabinet and accessible through the open face.

12. An ironing station comprising:

a cabinet comprising spaced side walls connected by a top wall to at least partially define an interior space accessible through an open face of the cabinet;

a base located within the interior space;

an ironing board stowably mounted to the cabinet for selective movement between a stowed position, wherein at least a portion of the ironing board is received within the interior space, and a use position;

at least one guide rail orientated at an angle other than vertical and slidably coupling the ironing board to the base to effect movement of the ironing board between the stowed position and the use position; and a platform for carrying the ironing board, the platform comprising at least one angled side segment, and a base mounted within the interior space of the cabinet, wherein the at least one guide rail is mounted between the at least one angled side segment and the base.

13. The ironing station according to claim 12 wherein the angle is less than 90°.

14. The ironing station according to claim 12, and further comprising a storage area defined within the interior space of the cabinet and accessible through the open face.

15. An ironing station comprising:

a cabinet comprising spaced side walls connected by a top wall to at least partially define an interior space accessible through an open face of the cabinet;

an ironing board stowably mounted to the cabinet for selective movement between a stowed position, wherein at least a portion of the ironing board is received within the interior space, and a use position; and a multi-position docking station provided on the top wall of the cabinet for docking an iron in at least two orientations;

wherein the multi-position docking station is movable between at least two discrete orientations.

16. The ironing station according to claim 15 wherein the multi-position docking station is movable between an infinite number of variable orientations.

17. The ironing station according to claim 15 wherein the multi-position docking station is rotatably coupled to the top wall of the cabinet.

18. The ironing station according to claim 17 wherein the multi-position docking station is rotatable between at least two discrete orientations.

19. The ironing station according to claim 17 wherein the multi-position docking station is rotatable 360°.

20. The ironing station according to claim 15 wherein the multi-position docking station comprises a rotating platform on which an iron is received.

21. The ironing station according to claim 15, and further comprising a storage area defined within the interior space of the cabinet and accessible through the open face.

22. The ironing station according to claim 15, and further comprising a cover for selectively covering the docking station.

23. The ironing station according to claim 22, and further comprising a storage area defined within the interior space of the cabinet and accessible through the open face.

24. The ironing station according to claim 22 wherein the cover is hingedly mounted to at least one of the top wall or the side walls.

* * * * *